US008550511B2

(12) United States Patent
Baars

(10) Patent No.: US 8,550,511 B2
(45) Date of Patent: Oct. 8, 2013

(54) REFUSE RETRIEVAL, STORAGE, AND DISPOSAL APPARATUS

(76) Inventor: Bryan T. Baars, Pendacola, FL (US)

( * ) Notice: Subject to any disclaimer, the term of this patent is extended or adjusted under 35 U.S.C. 154(b) by 957 days.

(21) Appl. No.: 12/604,726

(22) Filed: Oct. 23, 2009

(65) Prior Publication Data

US 2011/0094900 A1 Apr. 28, 2011

(51) Int. Cl.
*A01K 29/00* (2006.01)
*B65D 90/00* (2006.01)

(52) U.S. Cl.
USPC ..... 294/1.3; 294/2

(58) Field of Classification Search
USPC ..... 294/1.3, 1.4, 1.5, 2; 220/908, 908.3; 4/662, 431, 442; 100/226; 119/162, 166, 119/426; 206/205
See application file for complete search history.

(56) References Cited

U.S. PATENT DOCUMENTS

| | | | | |
|---|---|---|---|---|
| 3,139,299 | A | 6/1964 | Bowen | |
| 3,324,828 | A * | 6/1967 | Johnson | 119/161 |
| 3,438,321 | A * | 4/1969 | Gladwin | 141/73 |
| 3,699,592 | A * | 10/1972 | Minchak | 4/431 |
| 3,901,544 | A | 8/1975 | Tucciarone | |
| 4,042,269 | A | 8/1977 | Skermetta | |
| 4,119,337 | A * | 10/1978 | Sherhandt | 294/1.4 |
| 4,148,513 | A | 4/1979 | Gagne | |
| 4,225,174 | A * | 9/1980 | Hennessy et al. | 294/1.4 |
| 4,319,366 | A * | 3/1982 | Baker et al. | 4/431 |
| 4,555,132 | A | 11/1985 | Takoushian | |
| 4,741,566 | A | 5/1988 | Byung-Do et al. | |
| 4,744,380 | A * | 5/1988 | Sheriff | 294/1.3 |
| 4,953,744 | A * | 9/1990 | Koyama | 220/908.1 |
| 4,957,131 | A | 9/1990 | Robinson | |
| 5,097,750 | A * | 3/1992 | Oldham et al. | 220/908.3 |
| 5,335,952 | A | 8/1994 | Clapper | |
| 5,360,247 | A | 11/1994 | Vachter | |
| 5,482,337 | A | 1/1996 | Rose | |
| 5,683,129 | A | 11/1997 | Jensen | |
| 5,868,447 | A | 2/1999 | Clark et al. | |
| 5,918,323 | A * | 7/1999 | Smith | 4/262 |
| 6,039,370 | A | 3/2000 | Dooley, Jr. et al. | |
| 6,164,710 | A | 12/2000 | Shibuya | |
| 6,554,335 | B1 | 4/2003 | Kelly et al. | |
| 6,941,896 | B1 | 9/2005 | Morin | |
| 7,182,376 | B2 * | 2/2007 | Maginness | 294/1.3 |
| 7,258,076 | B1 | 8/2007 | Gantt | |
| 7,374,215 | B2 | 5/2008 | Anderson | |
| 7,717,891 | B1 * | 5/2010 | Whaley | 604/319 |
| 2002/0078899 | A1 | 6/2002 | Chiu | |
| 2004/0130169 | A1 | 7/2004 | Askingsi | |
| 2007/0024070 | A1 | 2/2007 | Aihiokhai | |
| 2009/0050065 | A1 | 2/2009 | Evans et al. | |
| 2010/0293741 | A1 * | 11/2010 | Ferris | 15/339 |

FOREIGN PATENT DOCUMENTS

| | | | |
|---|---|---|---|
| JP | 2005253350 | A | 9/2005 |
| JP | 2007306827 | A | 11/2007 |

* cited by examiner

*Primary Examiner* — Paul T Chin
(74) *Attorney, Agent, or Firm* — Luedeka Neely Group, P.C.

(57) ABSTRACT

A portable apparatus for extracting and properly disposing of refuse such as, for example, excrement. The apparatus includes a storage chamber for storing extracted refuse wherein the storage chamber is distinct from the extraction mechanism for extracting the refuse. The apparatus further includes a pumping mechanism for pumping fluid from a fluid source through a fluid conduit and into the storage chamber.

17 Claims, 23 Drawing Sheets

REFUSE RETRIEVAL, STORAGE, AND DISPOSAL APPARATUS

FIELD

This disclosure relates to the field of refuse remediation. More particularly, this disclosure relates to the extraction, temporary storage, and proper disposal of refuse.

BACKGROUND

Refuse extraction, storage, and disposal technology covers a broad range of applications including, for example, sanitation, recycling, farming, and energy production (e.g., methane production). The first category (i.e., sanitation) is typically a concern in areas where significant numbers of people visit, live and/or work.

For example, with regard to animal excrement, many parks require visitors traveling with pets to clean up after their pets. In fact many parks provide bags (or other containers) for visitors with pets to place pet droppings. These containers, however, may end up in a variety of places including, for example, trash cans and/or recycling containers. The use of bags or other similar containers to dispose of pet droppings results in a substantial volume of plastic and/or paper waste products in addition to the animal droppings themselves. Moreover, by using bags or other containers to store animal droppings, options such as human sewage systems designed precisely for dealing with animal excrement are avoided What is needed, therefore, is an apparatus for retrieving, temporarily storing, and properly disposing of refuse.

What is also needed is a method for retrieving, temporarily storing, and properly disposing of refuse.

SUMMARY

The above and other needs are met by a sanitation apparatus for retrieval and proper disposal of refuse. The apparatus includes a storage chamber for storing refuse; an extraction mechanism including an extraction apparatus attached adjacent the storage chamber for extracting refuse from a surface; a fluid conduit attached adjacent a proximal end of the storage chamber, a pumping mechanism attached proximate the proximal end of the storage chamber, the pumping mechanism in fluid communication with the fluid conduit and the storage chamber, for pumping fluid from a fluid source through the fluid conduit and into the storage chamber; and a gate located adjacent a distal end of the storage chamber, the gate operable to move from a closed gate position for storing refuse within the storage chamber to an open gate position for releasing stored refuse from the storage chamber.

The sanitation apparatus preferably includes an extraction chamber located adjacent the storage chamber wherein the extraction apparatus is operable to move through at least part of the extraction chamber. This embodiment preferably further includes a primary chamber including the extraction chamber and the storage chamber. This embodiment preferably further includes a door mechanism including a door actuator and a door located at a distal end of the primary chamber, wherein the door may be moved to an open door position or a closed door position by manipulating the door actuator. In a related embodiment the fluid conduit further includes an extension member that is extendable beyond the distal end of the primary chamber. Another related embodiment includes a support catch for use in partially supporting the sanitation apparatus at a location adjacent the fluid source. In another related embodiment, the sanitation apparatus further includes a wall section located between the storage chamber and the extraction chamber wherein at least a portion of the wall section includes perforations, the perforations for allowing fluid pumped by the pumping mechanism through the fluid conduit and into the storage chamber to flow between the storage chamber and the extraction chamber.

Additionally or alternatively, the sanitation apparatus preferably further includes a transfer mechanism for transferring the extracted refuse from the extraction apparatus to the storage chamber.

Additionally or alternatively, the sanitation apparatus preferably further includes a check valve for regulating flow of fluid through the fluid conduit into the storage chamber and preventing fluid located in the storage chamber from flowing back into the fluid conduit.

Additionally or alternatively, the pumping mechanism of the sanitation apparatus preferably further includes a hand powered pump, a battery powered pump, or a pump powered by electrical current accessed from a non-battery current source.

Additionally or alternatively, the pumping mechanism of the sanitation apparatus preferably further includes a shoulder strap attached adjacent the proximal end of the storage chamber and attached adjacent a distal end of the storage chamber and/or a handle attached adjacent the proximal end of the storage tank.

Additionally or alternatively, the extraction apparatus of the sanitation apparatus preferably further includes an extraction head including a movable member movable between an open extraction head position and a closed extraction head position; a handle; a shaft attached to the extraction head and the handle; and an actuation system including an actuator located proximate the handle, wherein the extraction apparatus can be reciprocated substantially parallel to the storage tank by pushing the handle, and wherein the movable member can be moved to the opened position or the closed position by manipulating the actuator, allowing a user to capture refuse within the extraction head and bring the extracted refuse within the extraction chamber. Preferably, the extraction head includes a first cross sectional shape, and wherein the transfer mechanism further comprises a ram configured for travel substantially along an imaginary first axis oriented substantially orthogonal to the cross section of the extraction head, wherein extracted refuse can be displaced out of a distal side of the extraction head and into the storage chamber as the ram travels substantially along the imaginary first axis. In a related embodiment the shaft further comprises an expandable shaft wherein the length of the shaft can be increased. In yet another related embodiment the ram includes a ram plate having the first cross sectional shape and a ram pole attached to the ram plate for manipulating the ram substantially along the imaginary first axis. In one embodiment, the ram pole includes a first portion, and a dynamic fastener attaching the first portion adjacent the ram plate.

In another aspect, embodiments of the disclosure provide a method for removing refuse from a surface and disposing of the refuse using a single retrieval device with no disposal bags. The method includes the steps of: (a) extracting refuse from a surface using an extraction apparatus; (b) transferring at least some of the extracted refuse to a storage chamber that is separate from but attached adjacent to the extraction apparatus; (c) pumping fluid to the storage chamber to form a mixture of pumped fluid and refuse; and (d) releasing at least some of the extracted and stored refuse and at least some of the pumped fluid to a proper disposal source. Preferably, step (c) further comprises agitating the mixture of pumped fluid and refuse. The agitating step is preferably caused by reciprocating a pump associated with the storage chamber.

Advantages of the apparatus and method described above are numerous and include, for example, a significant decrease in the amount of plastic and/or paper necessary to store extracted animal excrement.

Another advantage is that animal excrement may be extracted, temporarily stored, and disposed of in a desirable disposal location (e.g., a toilet) using a single apparatus.

Yet another advantage is that multiple sets of droppings in different locations may be extracted and temporarily stored prior to disposal of the overall extracted sum of droppings in one disposal step. This stands in contrast to similar devices in the prior art that require a user to extract a single set of animal excrement and then dispose of or otherwise unload the extracted animal excrement before extracting a second set of animal droppings.

Another advantage is the ability to use water from a water source (e.g., a toilet) to wash the apparatus where the extracted animal excrement is stored thereby creating a mixture of water and animal excrement. Then, the water and animal excrement mixture may be disposed of in a toilet or other proper disposal device. The mixing in of water better ensures that the storage area within the apparatus remains free from the buildup of animal excrement.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Adjacent: along side; proximate; close; not necessarily directly attached to.

Animal Excrement: substance excreted from an animal; primarily refers to fecal matter. Also referred to herein as "excrement" and/or "droppings."

Conduit: a flexible pipe-like structure of any cross-sectional shape and/or dimensions capable of channeling fluid from a first location to a second location.

Dynamic Fastener: A mechanical member holding a plurality of objects together wherein the mechanical member is capable of moving the plurality of members spatially relative to one another.

Extracting Head: an apparatus including at least one movable member, the apparatus including a cavity for holding a substance exhibiting properties of a solid substance.

Fluid: one or more substances wherein the overall mixture manifests the physical characteristic of rapidly changing shape at a steady rate when acted upon by an external force. A "fluid" may include a mixture including a solid, a liquid, and a gas component wherein each component may further include multiple solids, liquids, and gases, respectively.

Fluid Communication: a relationship between a first object and a second object wherein a fluid is free to flow from the first object to the second object (or vice versa).

Fluid Source: a source of a particular fluid.

Proximate: close; near; not necessarily directly attached to.

Ram: an apparatus including plate-like surface used for driving a substance in one or more directions (e.g., an extrusion ram).

Refuse: Discarded material including, without limitation, trash, animal excrement, dirt, dust, clippings, and small debris.

String: cord, thread, wire, filament, rope, cable, line, and other similar materials.

Figures 1A, 1B:
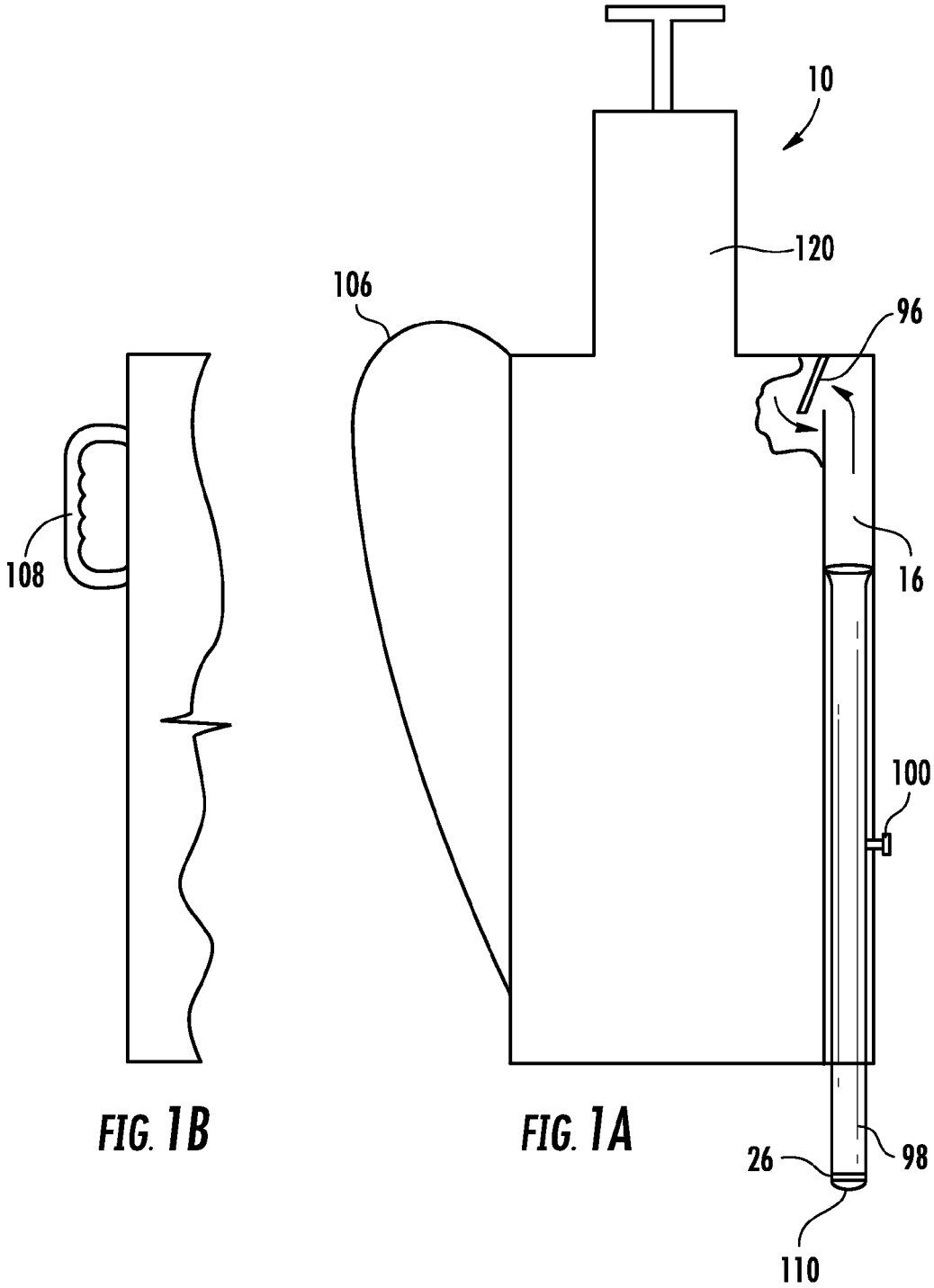
FIG. 1A shows a somewhat schematic first side view of an embodiment of the disclosed invention including a strap, the figure showing a cutaway view of the far right side to reveal the elements labeled 16 and 96.
FIG. 1B shows a partial view of an embodiment of the disclosed invention including a handle.
Figure 1C:
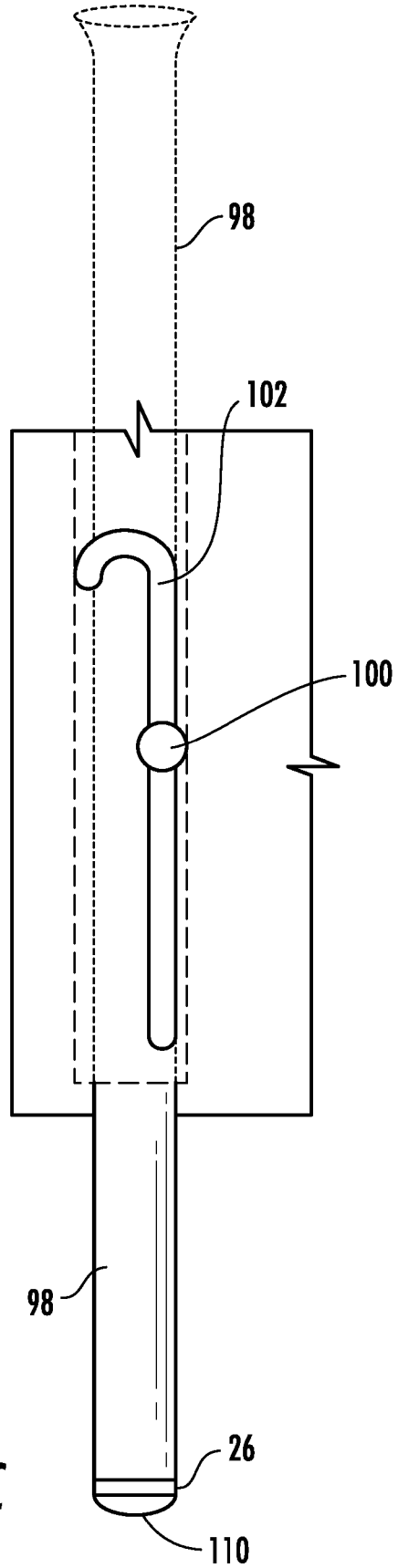
FIG. 1C shows a partial somewhat schematic and cutaway second side view of the apparatus shown in FIG. 1A wherein the apparatus in FIG. 1A has been rotated approximately 90 degrees (from the perspective of the bottom of the apparatus shown in FIG. 1A)

FIGS. 1A-1C show an embodiment of a first sanitation apparatus 10 for retrieving and properly disposing of refuse—preferably, animal excrement. The first sanitation apparatus 10 includes a storage chamber 12, an extraction mechanism 14, a fluid conduit 16, a pumping mechanism 18, and a gate 20. The extraction mechanism 14 is attached adjacent the storage chamber 10. The fluid conduit 16 is preferably attached proximate a proximal end 24 of the storage chamber 10. The pumping mechanism 18 is attached proximate the storage chamber 10 and provides a pumping force to draw fluid through a second end 26 of the fluid conduit. The fluid conduit 16 is in fluid communication with the storage chamber 10 such that fluid, when drawn through the fluid conduit 16, is channeled to the storage chamber 10. The gate 20 may be oriented in a closed gate position for storing refuse within the storage chamber 10 to an open gate position for releasing stored refuse from the storage chamber 10 so that the refuse and liquid mixture may be further mixed in the primary chamber prior to being released from the sanitation apparatus 10.

Figure 2A:
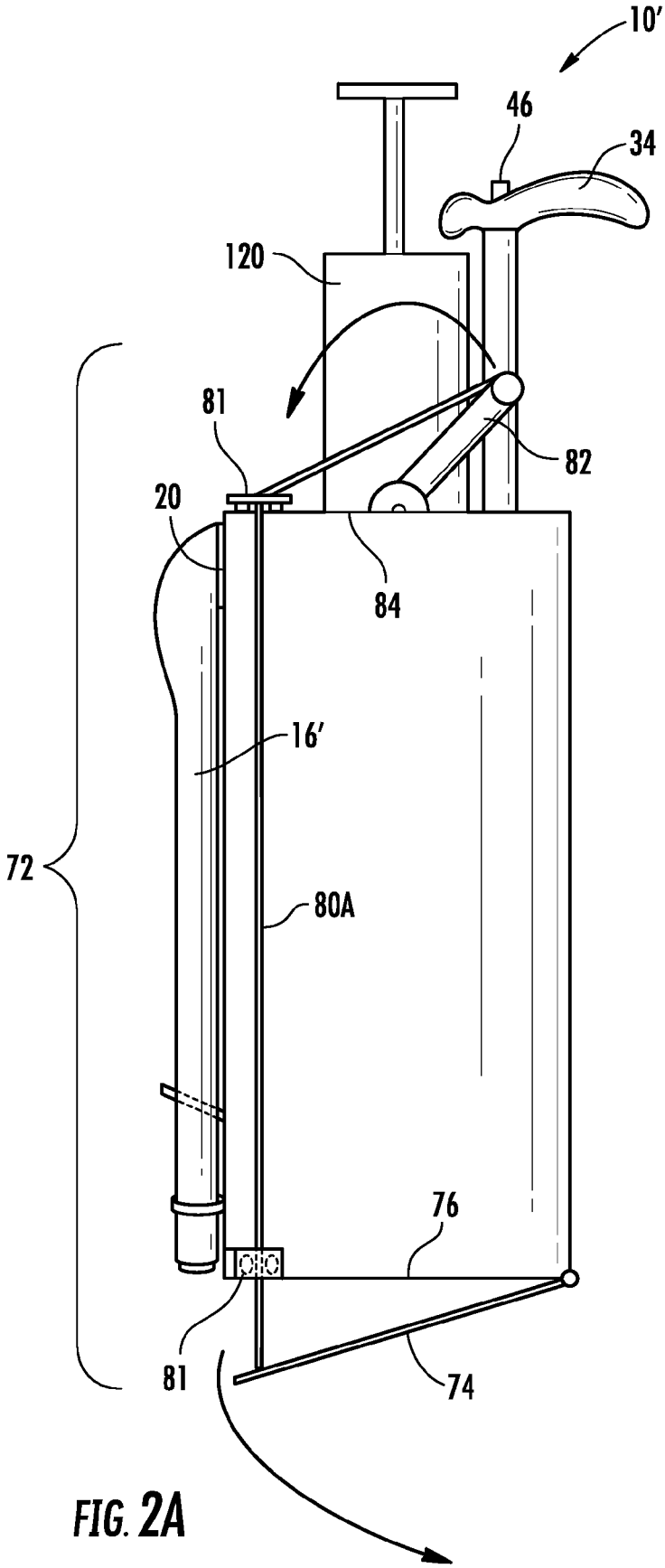
FIG. 2A shows a somewhat schematic first side view of an embodiment of the disclosed invention.
Figure 2B:
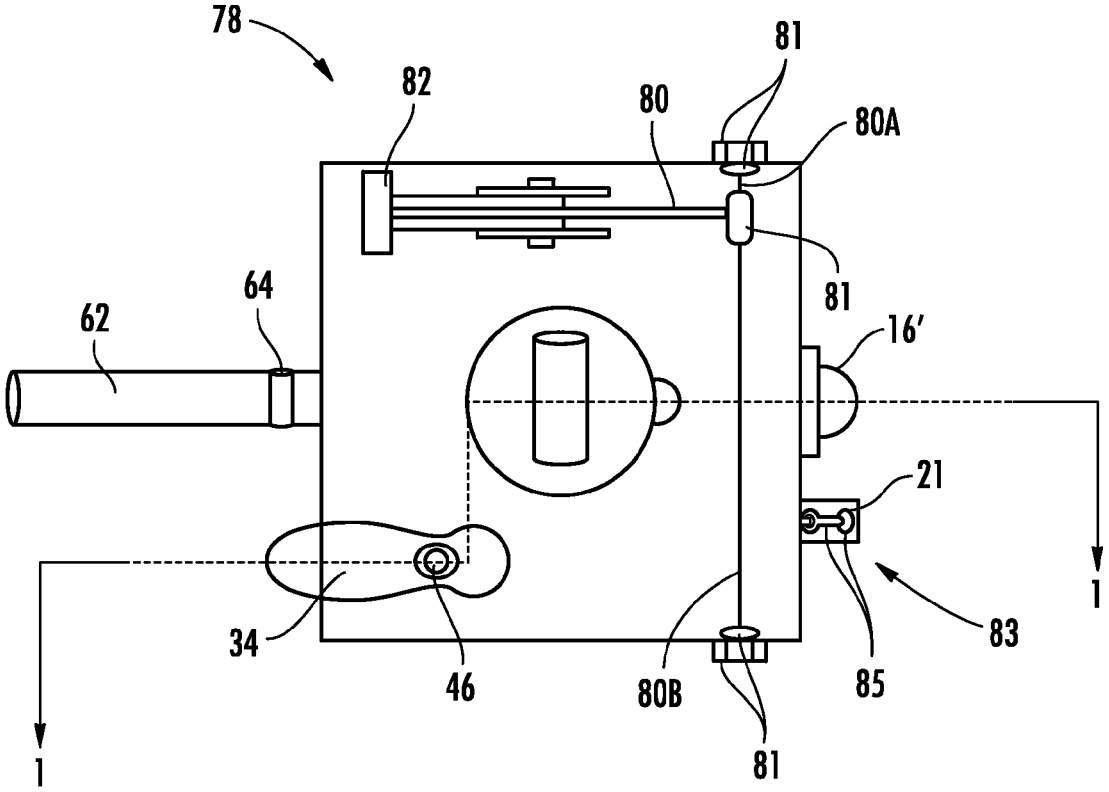
FIG. 2B shows a somewhat schematic top view of the apparatus shown in FIG. 2A wherein the apparatus in FIG. 2A has been rotated approximately 180 degrees (from the perspective of the bottom of the apparatus shown in FIG. 2A).
Figure 2C:
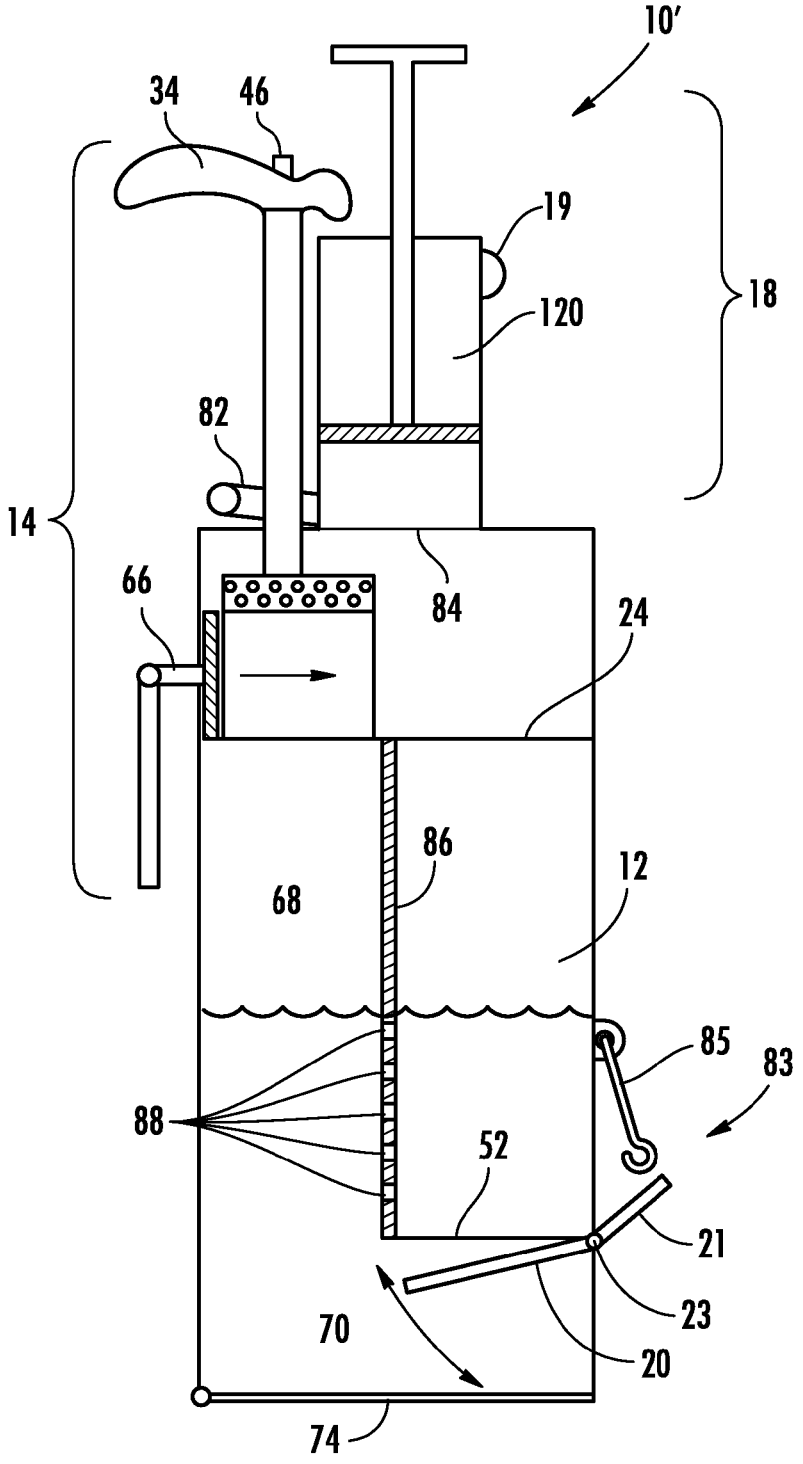
FIG. 2C shows a somewhat schematic second side cross-sectional view of the apparatus shown in FIGS. 2A-2B wherein the apparatus in FIG. 2A has been rotated approximately 180 degrees (from the perspective of the bottom of the apparatus shown in FIG. 2A) and wherein the second side cutaway view is based on imaginary cutting line 1 shown in FIG. 2B.
Figure 3:
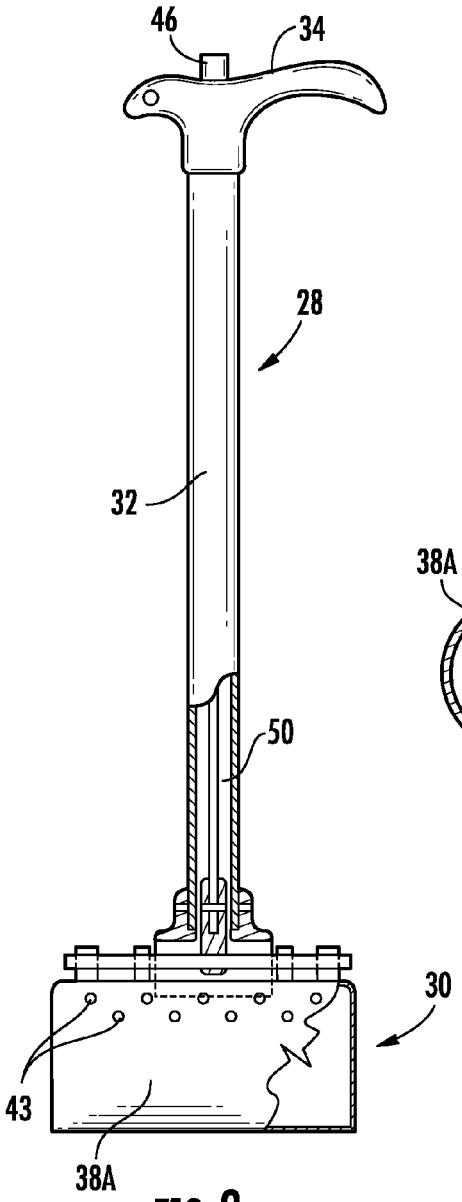
FIG. 3 shows a first view of a sub-apparatus as used in one embodiment of the invention.
Figure 4:
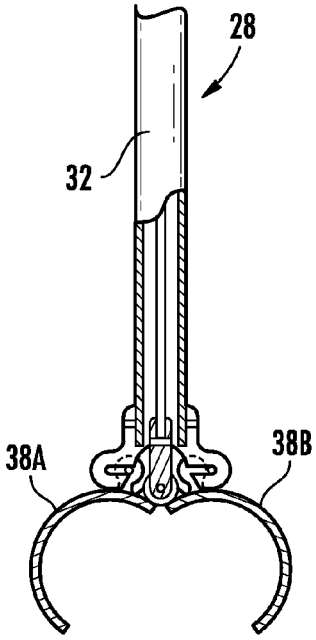
FIG. 4 shows a second view of a sub-apparatus as used in one embodiment of the invention.
Figure 5:
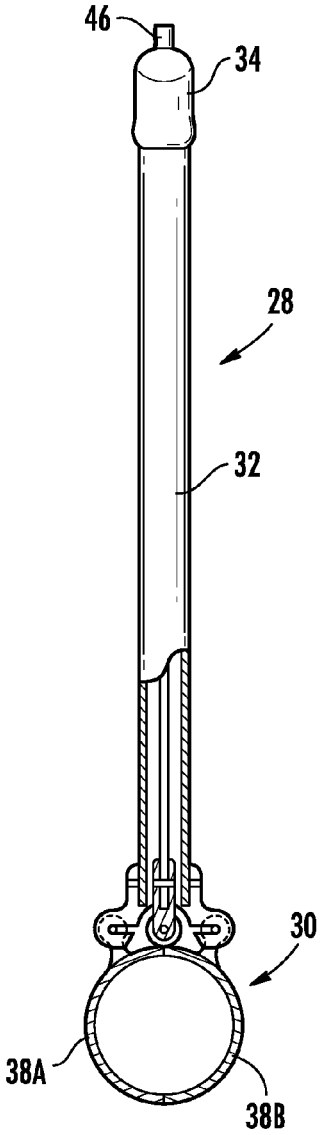
FIG. 5 shows a third view of a sub-apparatus as used in one embodiment of the invention.

A related embodiment including a second sanitation apparatus 10' is shown in FIGS. 2A-2C. A modified fluid conduit 16' used with the second sanitation apparatus 10' is distinguishable in that it is in the form of a flexible hose-like apparatus. The pumping mechanism 18 preferably includes an air intake 19 including an aperture and a removable aperture blocking member (e.g., a cap).

Figure 6:
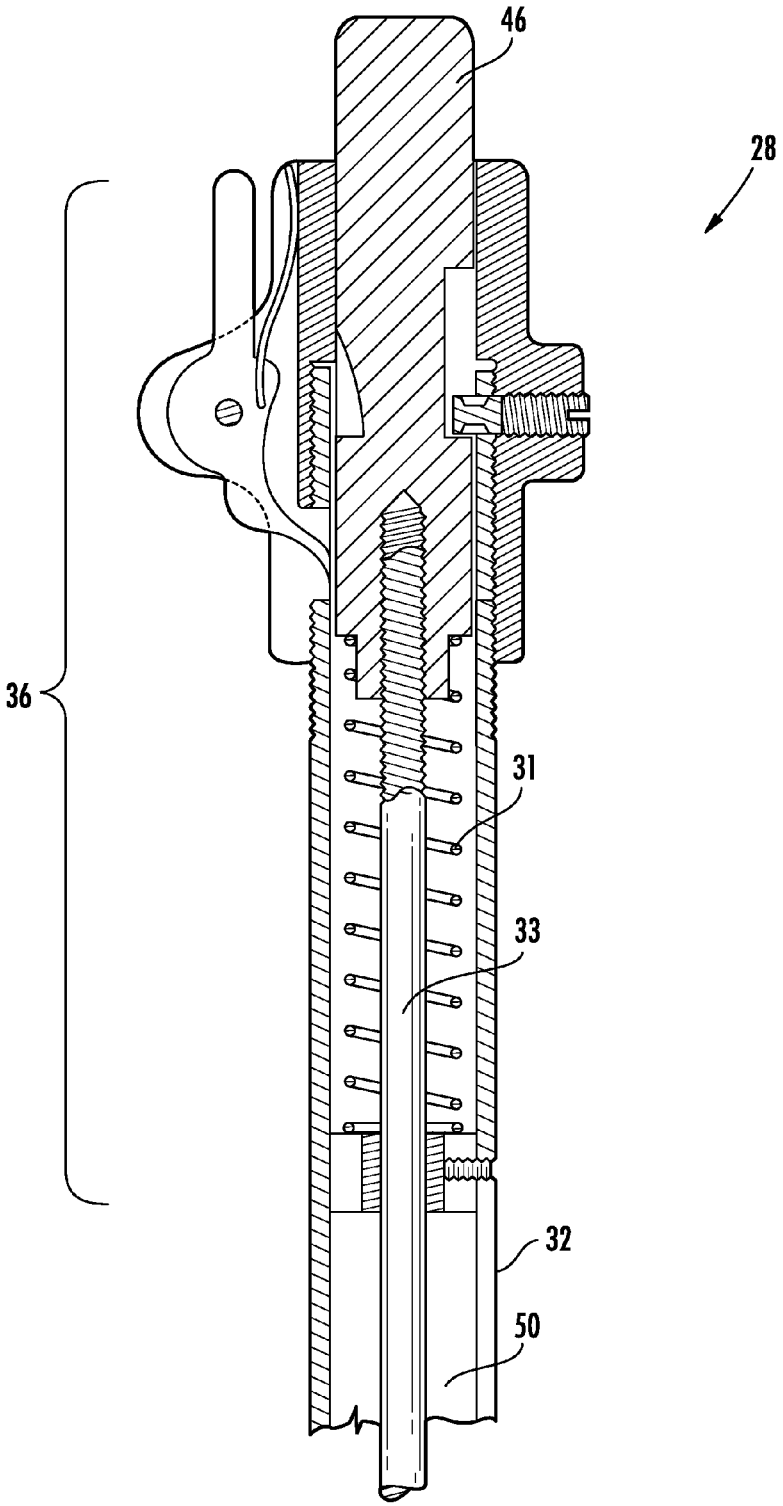
FIG. 6 shows close up cross-sectional view of part of an actuation mechanism shown in FIGS. 3-5.

The extraction mechanism 14 is used to extract refuse from a surface (e.g., the ground). The extraction mechanism 14 includes an extraction apparatus 28. There are a number of possible configurations for the extraction apparatus 28 including the extraction apparatus described in U.S. Pat. No. 3,841,686 to Gallo et al. entitled "Pet Waste Pickup Device" which issued on or about Oct. 15, 1974, the disclosure of which is incorporated herein by reference in its entirety. FIGS. 3-6 show a version of an extraction apparatus 28 that may be used in the extraction mechanism 14. The actuator 46 is biased upwards by a biasing device such as a coil spring 31 as shown in FIG. 6. The actuator 46 is also attached along an axially movable first actuating shaft 33 which, when the shaft 33 is moved downward (for example, in response to a user depressing the actuator 46), the shaft 33 or a structure attached thereto preferably operates as a wedge to drive a first movable member 38A away from a stationary member or, alternatively a second movable member 3813.

Figure 7:
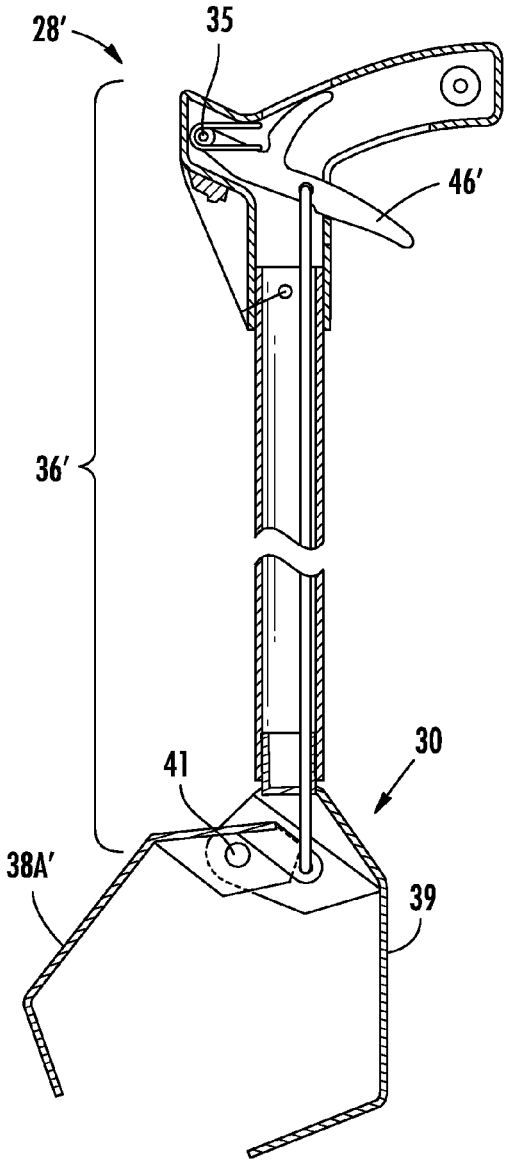
FIG. 7 shows a first view of another embodiment of a sub-apparatus as used in one embodiment of the invention.
Figure 8:
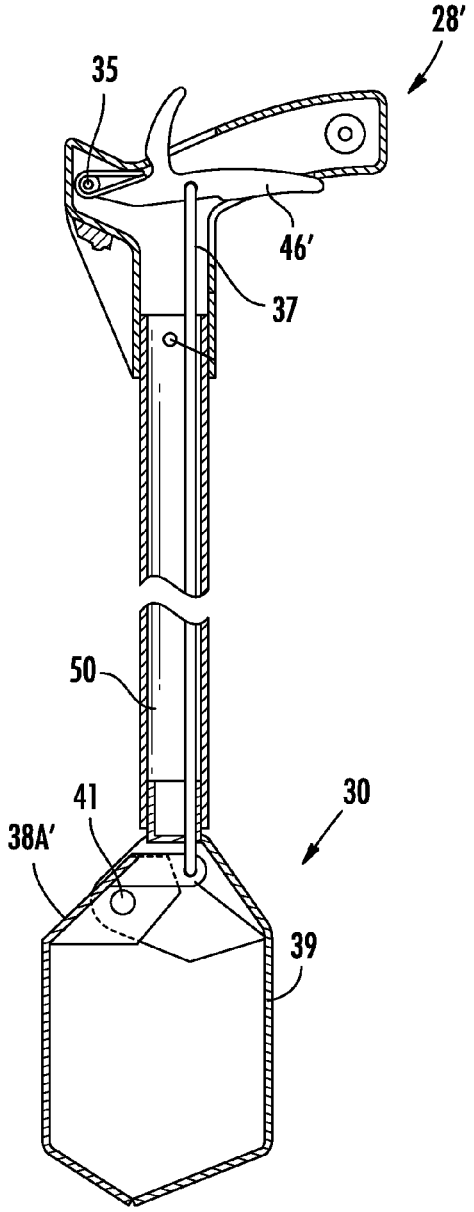
FIG. 8 shows a modified first view of another embodiment of a sub-apparatus as used in one embodiment of the invention.
Figure 9:
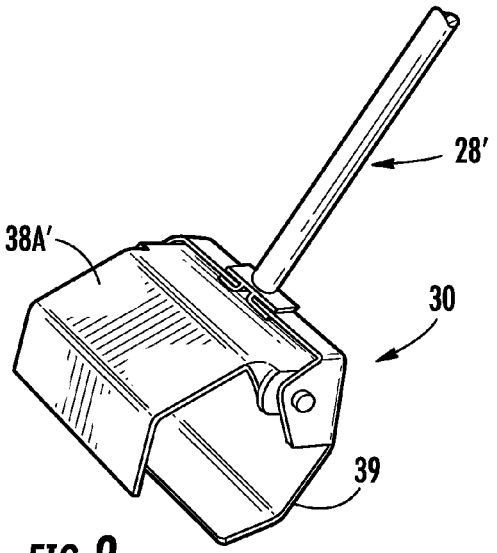
FIG. 9 shows a second view of another embodiment of a sub-apparatus as used in one embodiment of the invention.
Figure 10:
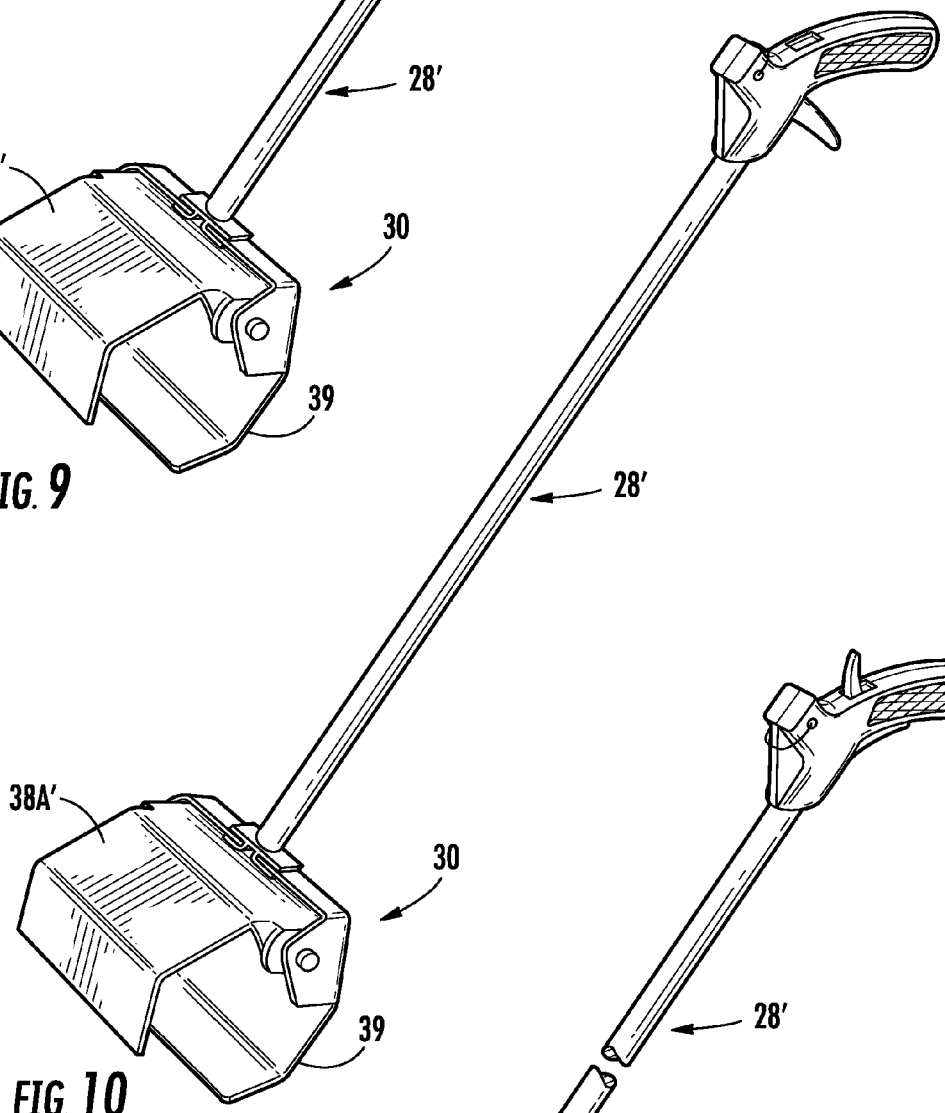
FIG. 10 shows a third view of another embodiment of a sub-apparatus as used in one embodiment of the invention.
Figure 11:
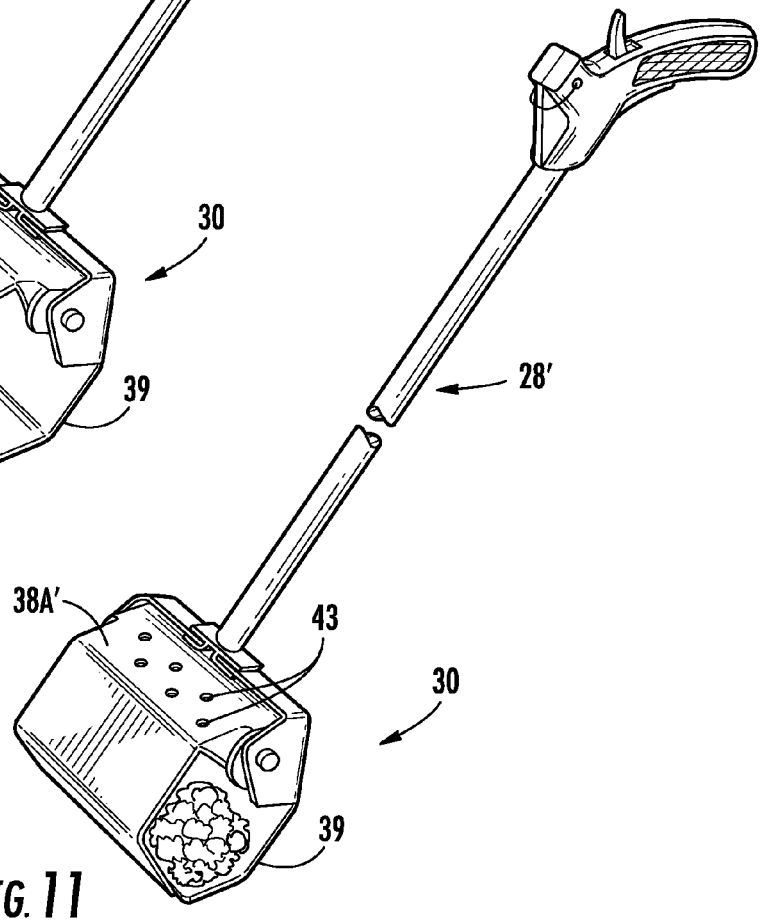
FIG. 11 shows a modified third view of another embodiment of a sub-apparatus as used in one embodiment of the invention.

Another example of an extraction apparatus 28' that may be used in the extraction mechanism 14 is described in U.S. Pat. No. 4,225,174 to Hennessey et al. entitled "Jaw-Type Refuse Collection Device" which issued on or about Sep. 30, 1980, shown in FIGS. 7-11, the disclosure of which is incorporated herein by reference in its entirety. In this particular embodiment, the actuator 46' is biased to an open position (shown in FIG. 7) by a biasing member such as a torque spring 35. Actuation of the actuator 46' causes a second actuating shaft 37 attached adjacent the actuator 46' to move upward axially along with the actuator 46'. The embodiment shown in FIGS. 7-8 includes one movable member 38A' and one relatively stationary member 39. The movable member 38A' is pivotally attached adjacent the stationary member 39 about a pivot extension 41 so that the movable member rotates toward a closed position when the actuator 46' is engaged. When the actuator 46 is disengaged, the movable member 38A' returns to an open position.

Although specific examples of extraction apparatuses that may be used in the extraction mechanism 14 are described herein, many other configurations known to person having ordinary skill in the art are contemplated by this disclosure.

The extraction apparatus 28 preferably includes an extraction head 30, a shaft 32, a handle 34, and an actuation system including, for example, the first actuation system 36 displayed with respect to FIGS. 3-6 or a second actuation system 36' displayed with respect to FIGS. 7-11. The extraction head 30 preferably includes a movable member 38 movable between an open extraction head position and a closed extraction head position wherein the extraction head 30 forms a laterally enclosed cavity 40 when the movable member 38 is substantially in the closed extraction head position. The extraction head 30 also preferably includes a plurality apertures 39. The extraction head 30 is attached proximate a distal end 42 of the shaft 32 and the handle 34 is attached proximate a proximal end 44 of the shaft 32. The actuation system (e.g., the first actuation system 36 or the second actuation system 36') includes an actuator (such as, for example, a first actuator 46 or a second actuator 46') located adjacent the handle 34. The actuation system causes the movable member 38 to move from a closed extraction head position to an open extraction head position (or vice versa).

Figure 12:
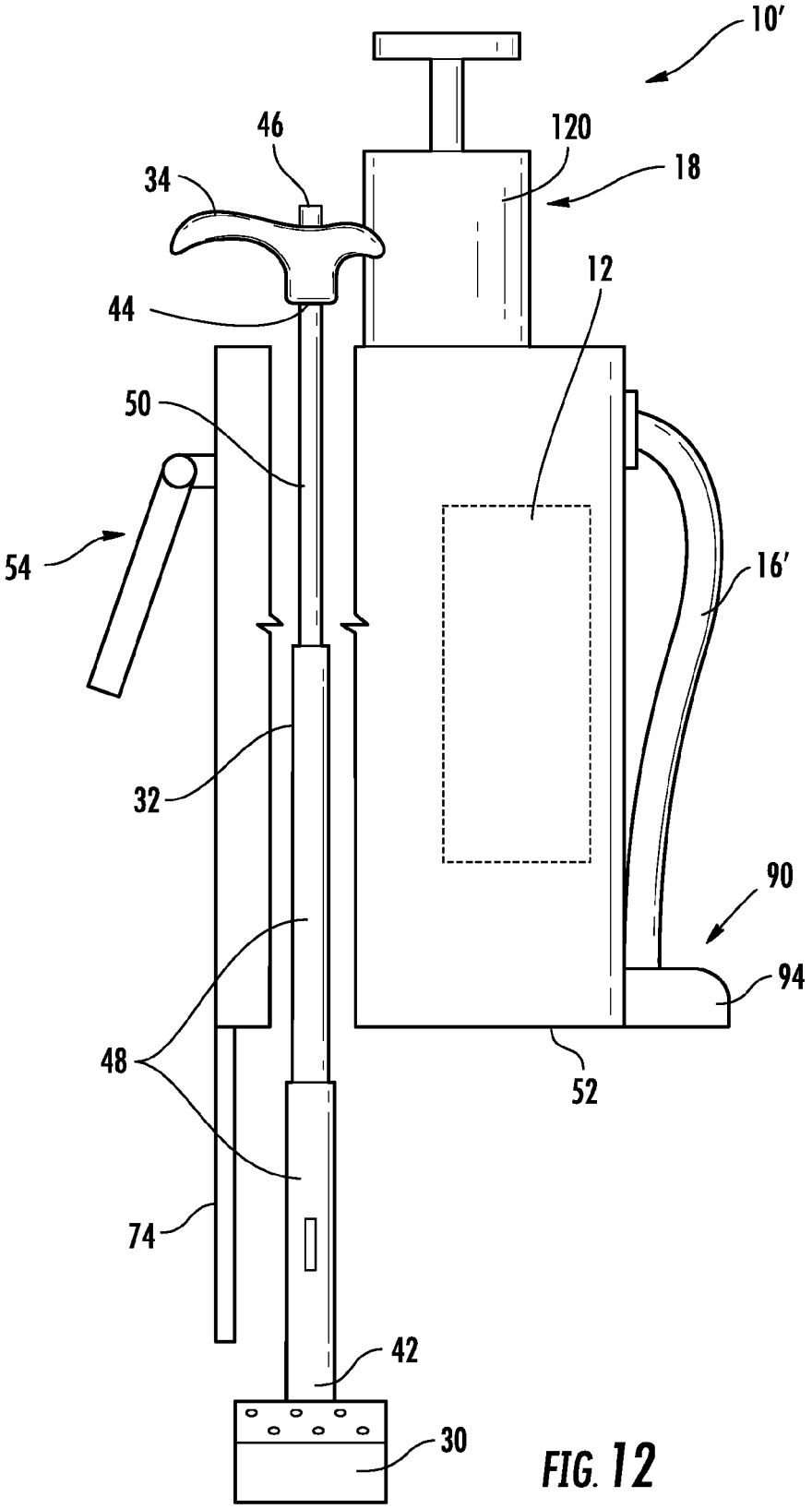
FIG. 12 shows a partial cutaway view of the apparatus shown in FIG. 2C with one of the elements in an extended position.
Figure 13A:
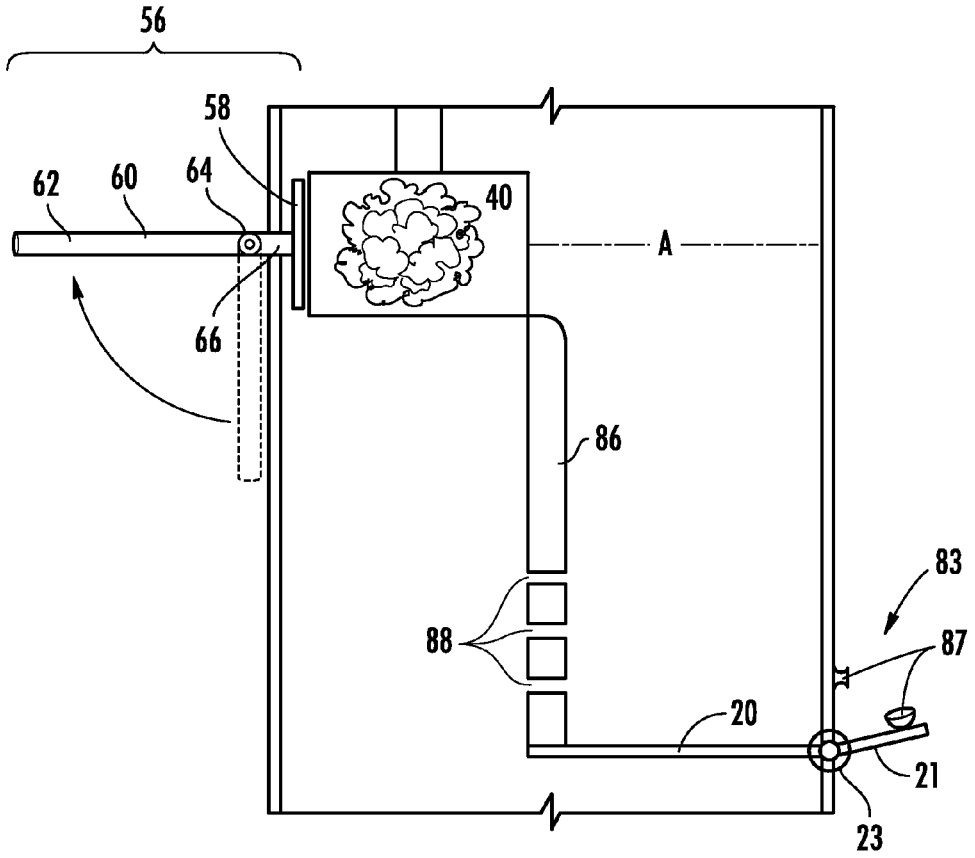
FIG. 13A shows a partial somewhat schematic side cutaway view of the apparatus shown in FIG. 2B wherein a movable element is located in a first position.
Figure 13B:
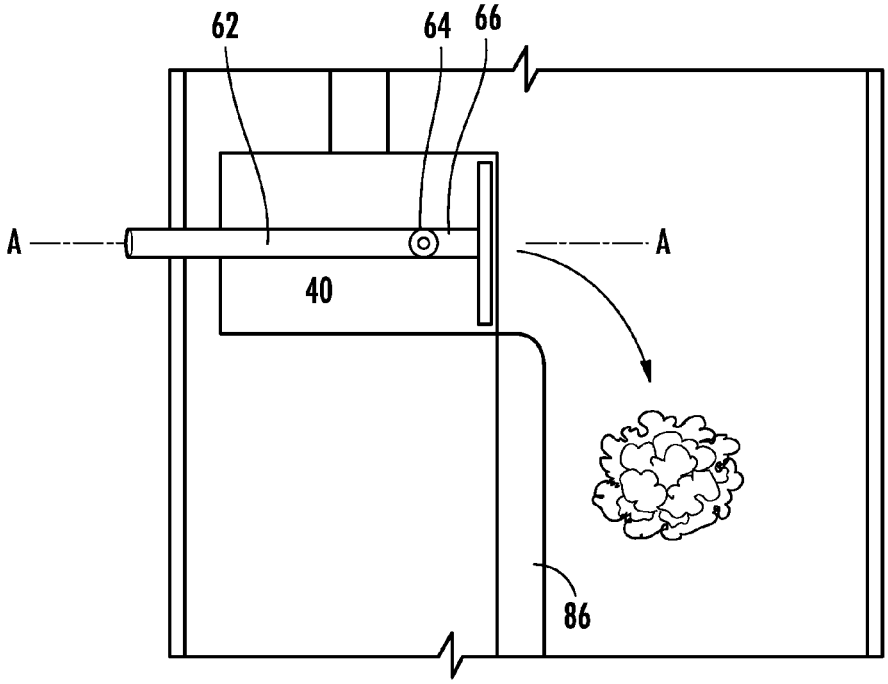
FIG. 13B shows another partial somewhat schematic side cutaway view of the apparatus shown in FIG. 2B wherein the movable element is in a second position.
Figure 14:
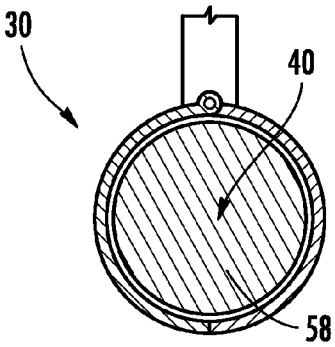
FIG. 14 shows one embodiment of a possible view along axis A in FIG. 13A toward element 58.
Figure 15:
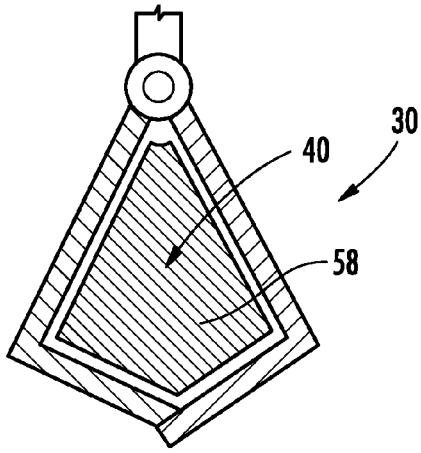
FIG. 15 shows another embodiment of a possible view along axis A in FIG. 13A toward element 58.

As shown in FIG. 12, in some embodiments, the shaft 32 is expandable lengthwise. In one preferred embodiment, for example, the outer layer(s) 48 of the shaft 32 are oriented in a telescopic configuration similar to that of a telescopic umbrella or other telescopically extendable device. Any portions of the actuation system 36 running along the shaft 32 preferably extend within a hollow core 50 of the shaft 32. Regardless of whether the shaft 32 is expandable or not, the extraction apparatus 28 can be reciprocated in a direction substantially parallel to the storage chamber 12 so that the extraction head 30 can be maneuvered beyond a distal end 52 of the storage chamber 12.

The storage chamber 12 is used to temporarily store refuse after such refuse has been extracted. In one embodiment, the extracted refuse may be transferred to the storage chamber 12 from the extraction head 30 by orienting the sanitation apparatus 10 so that gravity acts on the extracted refuse causing the refuse to fall from the extraction head 30 into the storage chamber 12.

Preferably, the extraction mechanism 14 further includes a transfer mechanism 54 for transferring extracted refuse from the extraction head 30 to the storage chamber 12, embodiments of which are shown in FIGS. 13A, 13B, 14, and 15. In a preferred embodiment, the transfer mechanism 54 further includes a ram 56 configured for travel along an imaginary first axis "A" along the length of the extraction head wherein the ram 56 includes a ram plate 58 which is configured to fit tightly within the laterally enclosed cavity 40 of the extraction head 30. If refuse is present within the cavity 40, such refuse can be displaced by the ram 56 into the storage chamber 12 as the ram plate 58 is moved along the first axis A toward the proximal end 24 of the storage chamber 12. The transfer mechanism 54 preferably further includes a ram pole 60 attached adjacent the ram plate 58 for manipulating the ram 56 along the first axis A.

In a preferred embodiment, the ram pole 60 includes a first section 62 and a dynamic fastener 64 wherein the first section 62 and the ram plate 58 are attached adjacent the dynamic fastener 64. In a related embodiment, a second section 66 of the ram pole 60 is attached adjacent the ram plate 58 wherein the first section 62 of the ram pole 60 and the second section 66 of the ram pole 60 are attached adjacent the dynamic fastener 64 as shown in FIGS. 2B, 2C, 13A, and 13B. The dynamic fastener 64 is preferably in the form of a hinge joint, a rotatable hinge joint, a ball and socket joint, or other movable arrangement. In one embodiment, the first section 62 of the ram pole 60 can be physically disengaged with the second section of the ram pole 66. In a simplified embodiment, the ram 56 includes the ram plate 58 and the ram pole 60 attached orthogonal to the ram plate 58.

In one embodiment, the sanitation apparatus 10 (or 10') includes an extraction chamber 68 located adjacent the storage chamber 12. In this embodiment, the extraction apparatus 28 is configured to move through at least a part of the extraction chamber 68 in order to extract refuse from a surface. Preferably, the sanitation apparatus 10 (or 10') further includes a primary chamber 70 that includes the storage chamber 12 and the extraction chamber 68. Preferably, the sanitation apparatus 10 (or 10') further includes a door mechanism 72 including a door 74 attached adjacent a distal end 76 of the primary chamber 70 and a door actuator 78 attached adjacent the primary chamber 70 for opening and closing the door 74. The door 74 may be subdivided into two or more doors. The manner in which the door mechanism 72 operates to open and close the door 74 may vary from a multitude of different mechanical door opening mechanisms known to persons having ordinary skill in the art. The door mechanism 72 shown in FIGS. 2A and 2C, includes one or more strings 80 (80A and 80B) attached adjacent the door 74 and also attached adjacent the door actuator 78 (e.g., a lever 82) at a proximal end 84 of the primary chamber 70. The strings 80A and 80B are directed by guide members 81 for maintaining the movement of the strings 80A and 80B within a specific area. Many other door mechanisms can be used to open and close the door 74 including, for example, an automatic door actuation system including a battery powered motor wherein the string(s) are reciprocally wound and reverse wound on a spool associated with rotatable shaft moved by the motor. Alternatively, a door mechanism may be used that does not use strings but instead uses multiple bars that pivot about one another. Additionally, a spring and/or a dampener may be used to control or otherwise bias the movement of the door 74.

In one embodiment, the extraction chamber 68 and the storage chamber 12 are separated at least in part by a wall section 86 including a plurality of perforations 88 for allowing fluid pumped into the storage chamber 12 to flow between the storage chamber 12 and the extraction chamber 68. At any point when both the gate 20 and the door 74 are in their respective "open" positions and the sanitation apparatus 10 is oriented in a substantially upright position, any fluid and refuse contained in the primary chamber 70 is substantially flushed out of the primary chamber 70. In one embodiment, the gate 20 can be opened by placing pressure on a tab 21 attached proximate the gate 20 wherein the gate 20 is biased in a "closed" position via a biasing member 23 such as, for example, a spring. The gate 20 can be held in an open position using a fastener 83 such as, for example, a hook and loop 85 or a snapping mechanism 87 during a mixing step wherein any stored refuse is mixed with fluid that has been pumped into the sanitation apparatus 10. Although fluid is preferably pumped into the storage chamber 12 so as to facilitate removal of substantially all of any refuse stored therein after the gate is opened, fluid may alternatively or additionally be introduced into one or more other portions of the primary chamber 70.

Figure 16:
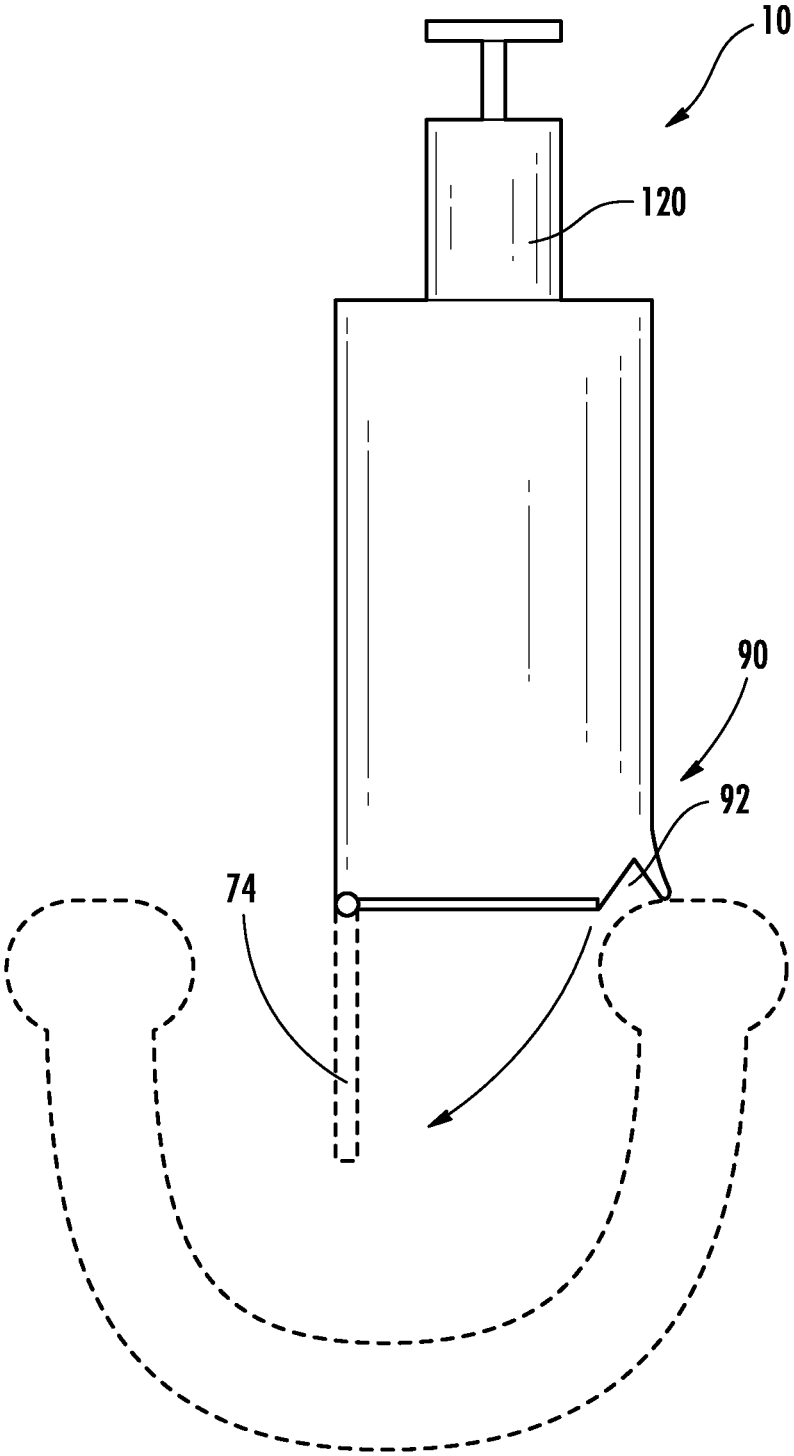
FIG. 16 shows a side view of an embodiment of the invention partially resting on the rim of a toilet bowl (cutaway)
Figure 17:
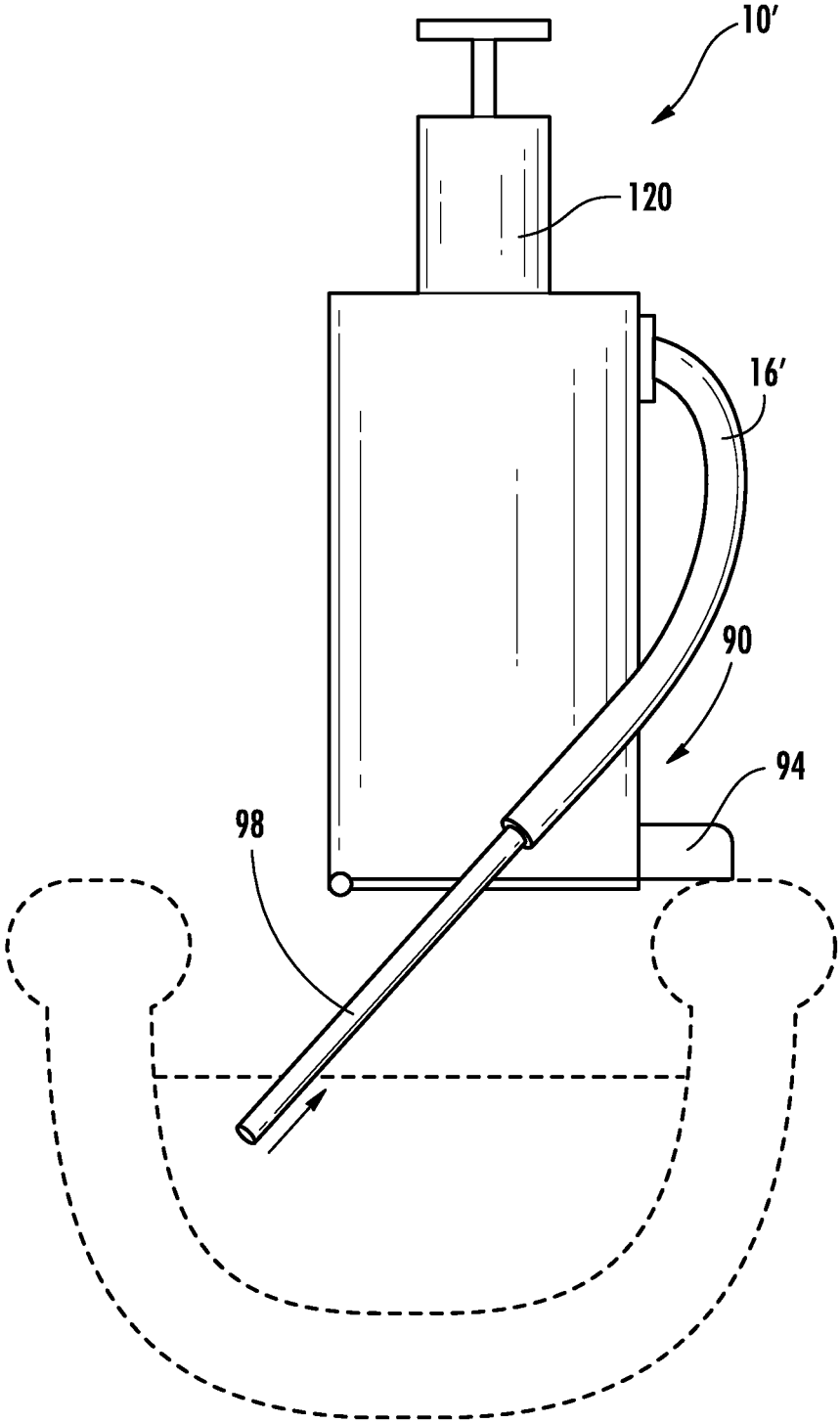
FIG. 17 shows a side view of an embodiment of the invention partially resting on the rim of a toilet bowl (cutaway) wherein fluid is being removed from the toilet bowl.

Preferably, the sanitation apparatus 10 also includes a support catch 90 to be used to rest the sanitation on the edge of a sanitation sink (e.g., a toilet) so that refuse and fluid is flushed into the sanitation sink after the door 74 is opened. The support catch 90 may be in the form of, for example, a notch 92 in the outer surface of the sanitation device as shown in FIG. 16 or, for example, an appendage 94 attached adjacent the bottom surface of the door 74 as shown in FIG. 17. Any similar notch or appendage type support feature for resting or partially resting embodiments of the sanitation apparatus 10 is contemplated in this disclosure.

Figure 18:
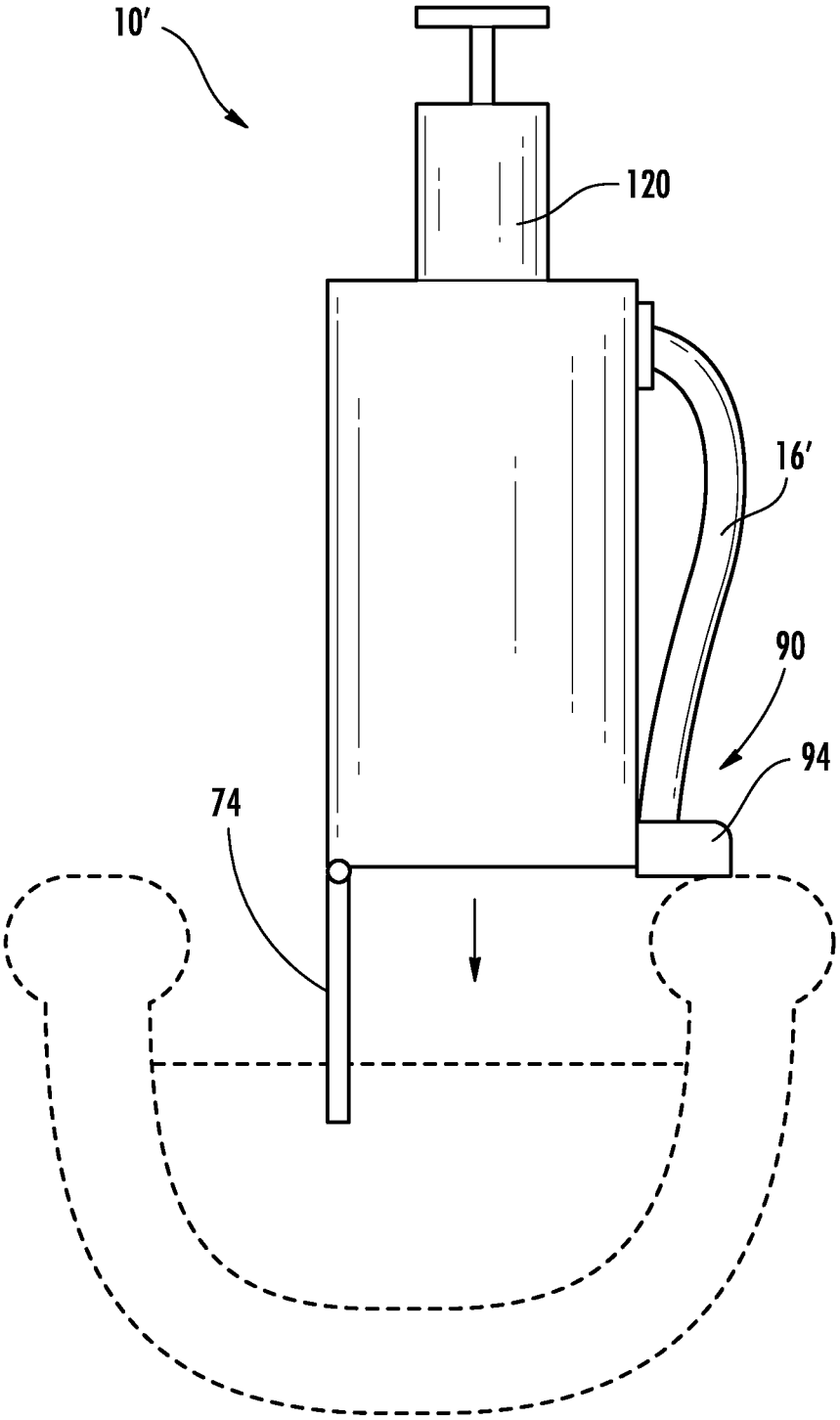
FIG. 18 shows a side view of an embodiment of the invention partially resting on the rim of a toilet bowl (cutaway).

In another embodiment, the sanitation apparatus 10 preferably includes a check valve 96 to prevent fluid from escaping the storage chamber 12. The fluid conduit 16 preferably includes an extension member 98 that is extendable beyond the distal end 76 of the primary chamber 70. In one embodiment, the extension member 98 may be moved using a protuberance 100 that is free to travel along a defined perforation 102. The extension member 98 preferably extends telescopically as shown in FIGS. 1A and 1C. The fluid conduit 16' may be in the form of a flexible tube that may be removably attached adjacent the side of the primary chamber 70 as shown in FIGS. 2A, 17, and 18 or, alternatively, the fluid conduit 16 may be built into the primary chamber 70 as shown in FIGS. 1A and 1C. The pumping mechanism 18 responsible for pumping fluid through the fluid conduit 16 preferably includes a hand powered pump and/or a battery powered pump. Alternatively or additionally, the pumping mechanism 18 may include a pump powered by electricity from a non-battery source. For example, the pumping mechanism 18 may include a wire and a plug to supply electricity to the pumping mechanism 18 from an electrical outlet, an automobile cigarette lighter, or other energy source that is or may be converted into electricity.

In order to help carry embodiments of the sanitation apparatus 10, a carrying feature is also preferably included as shown, for example, in FIG. 1A (showing a shoulder strap 106) and FIG. 1B (showing a handle 108).

Preferably, embodiments of the sanitation apparatus are made primarily of lightweight materials such as, for example, aluminum or plastic. Other materials such as rubber preferably may be included at least around the periphery of portions that need to remain substantially sealed from fluid leakage (i.e., areas near the door 74). Although specific preferred materials are discussed herein, embodiments of the sanitation apparatus are not limited to any particular type of construction material and different materials may be desirable depending on how the sanitation apparatus will be used. Additionally, the outer shape of the various embodiments of the sanitation apparatus described herein may vary significantly depending on overall sizing concerns, the relative organization and spacing of internal parts, and aesthetic concerns.

Figure 19:
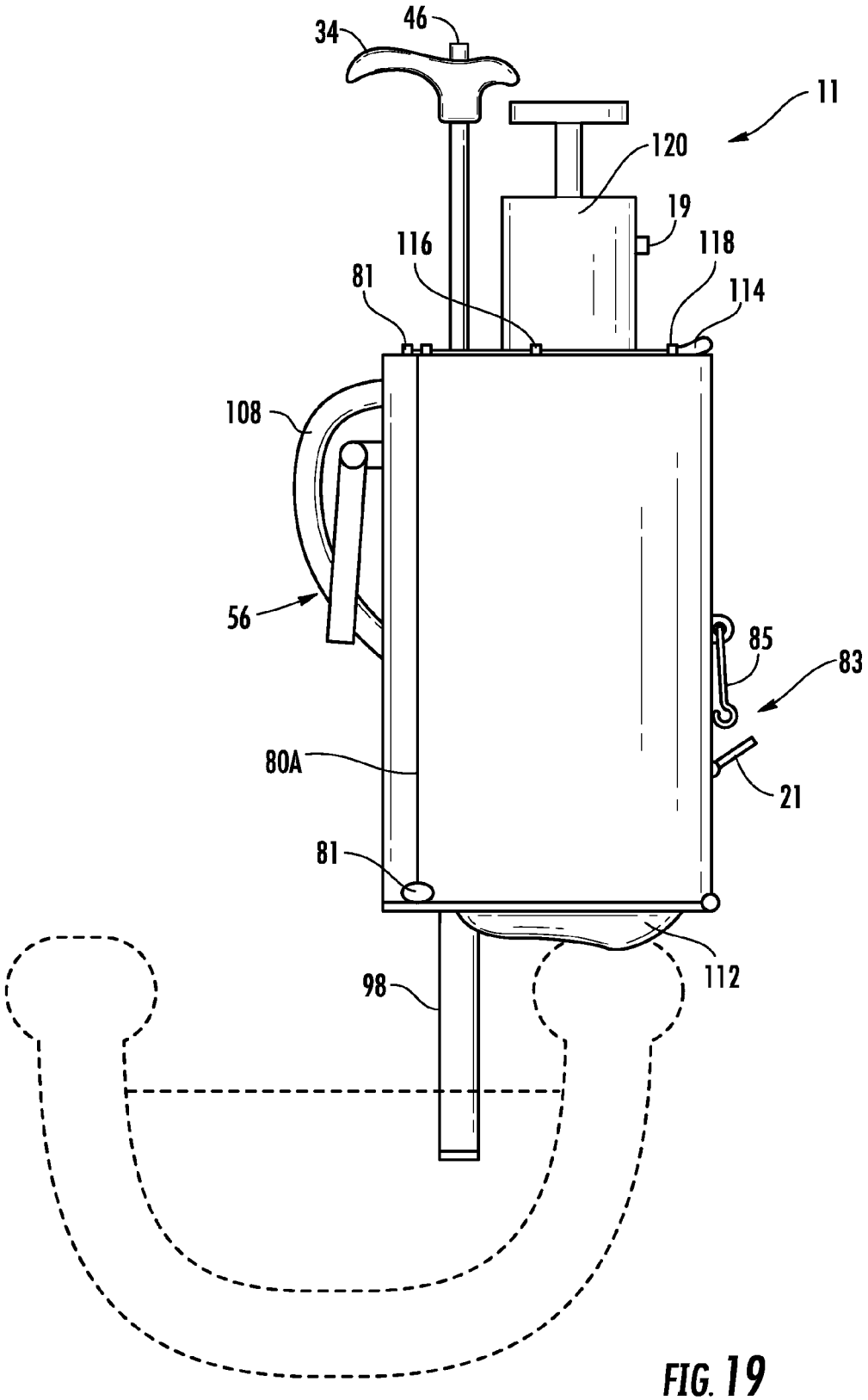
FIG. 19 shows a side view of an embodiment of the invention resting on the rim of a toilet bowl (cutaway) wherein a structure has been lowered into the bowl for displacing fluid from the bowl into the structure.
Figure 20A:
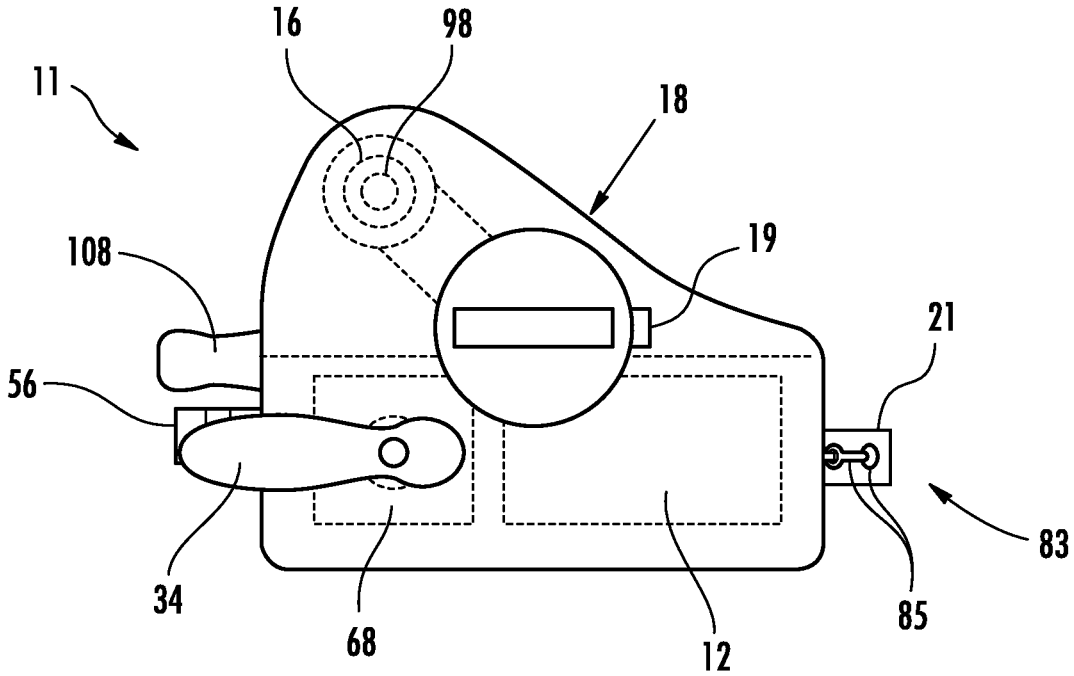
FIG. 20A shows a somewhat schematic top view of the embodiment shown in FIG. 19 including dotted outlines of internal features while excluding some external features for clarity.
Figure 20B:
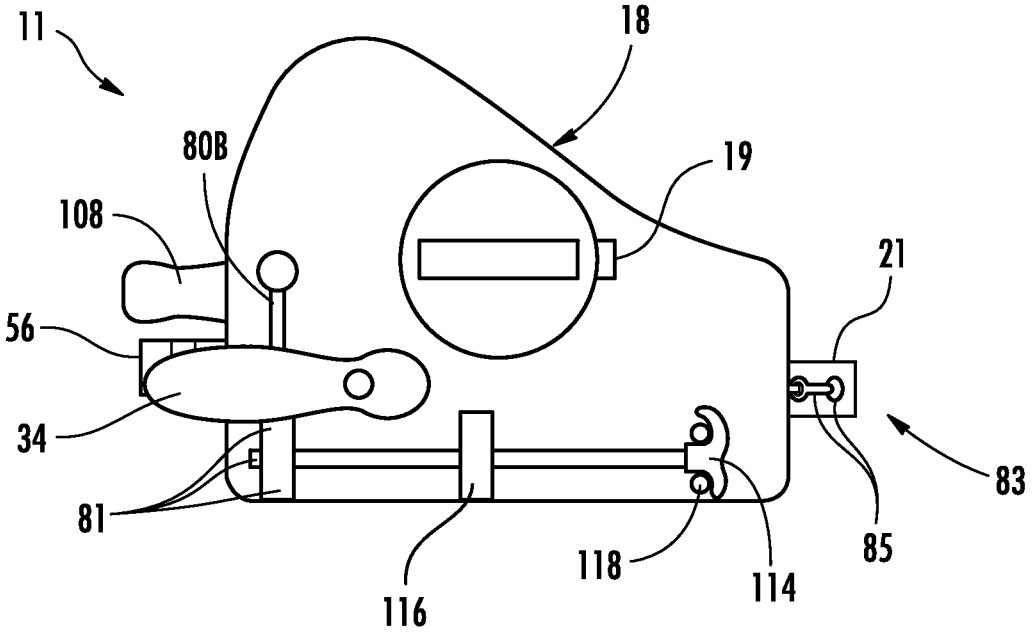
FIG. 20B shows another top view of the embodiment shown in FIG. 19.
Figure 20C:
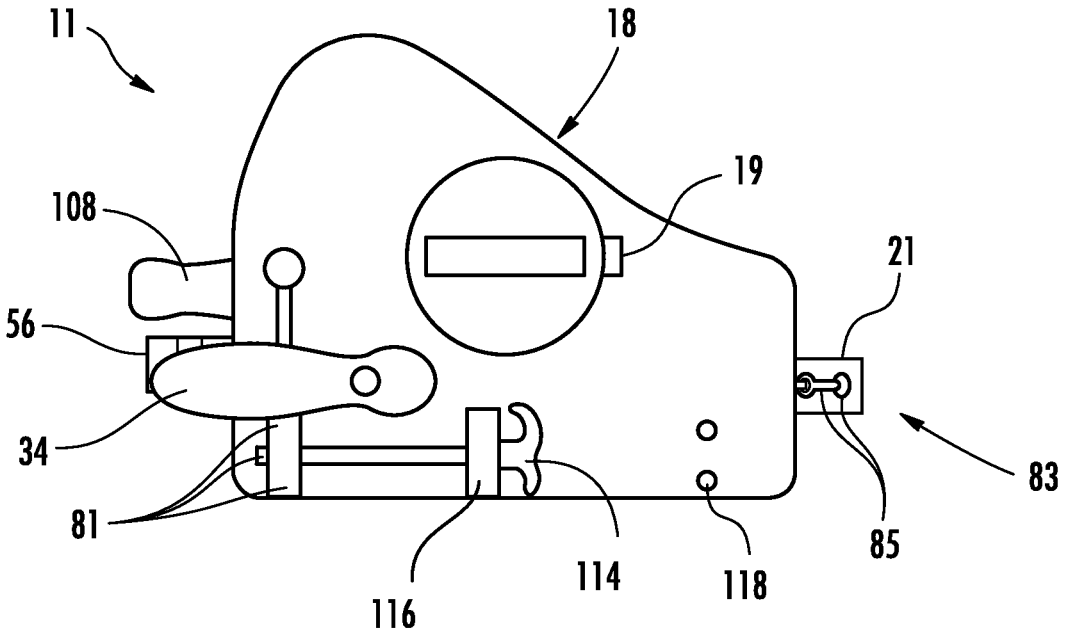
FIG. 20C shows yet another top view of the embodiment shown in FIG. 19.
Figure 21:
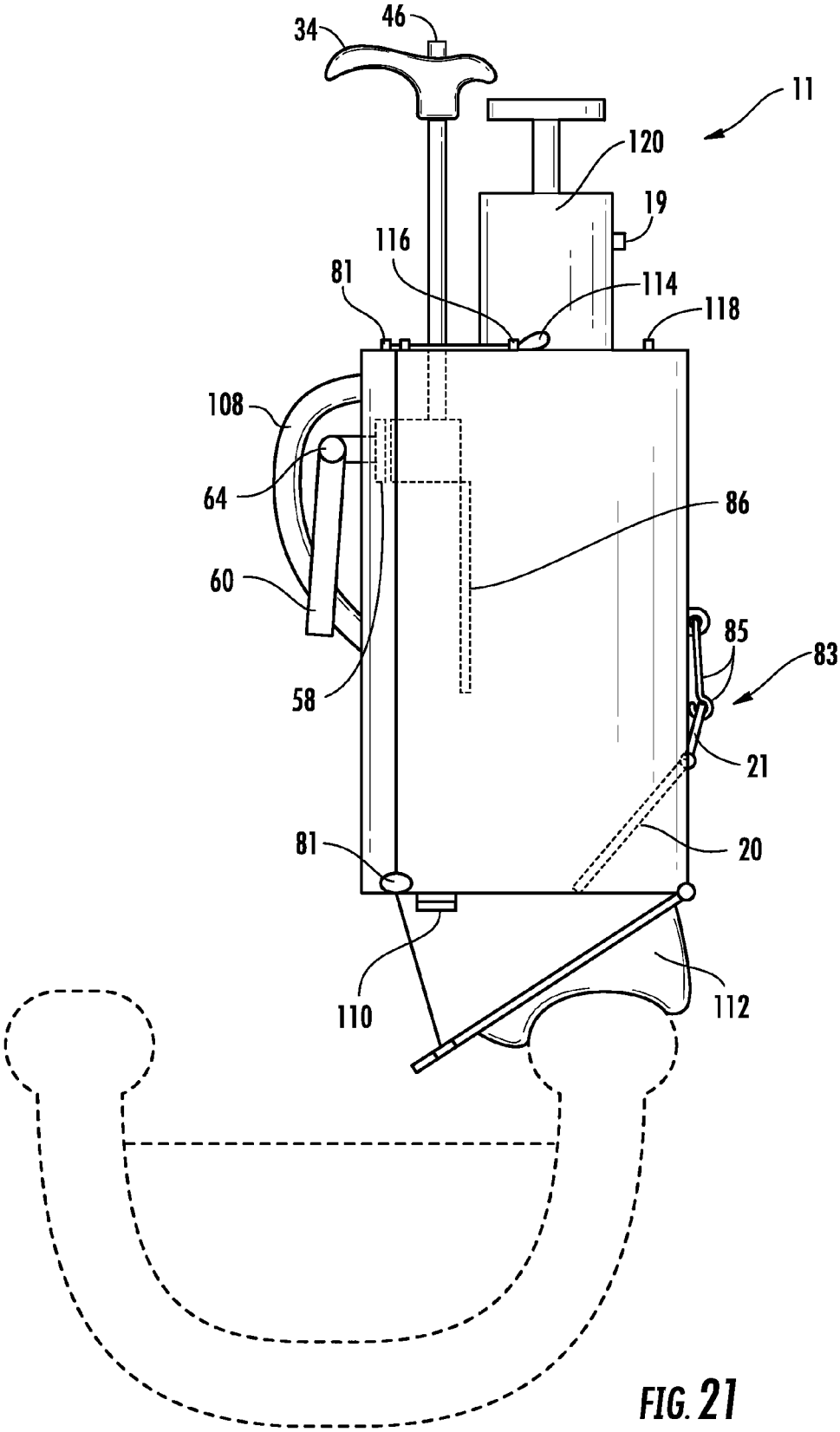
FIG. 21 shows a somewhat schematic side view of an embodiment of the invention partially resting on the rim of a toilet bowl (cutaway) and including dotted outlines of internal structural features.

FIGS. 19-21 show an embodiment of a sanitation apparatus 11 including a support catch 90 in the form of a pad 112, preferably made of rubber, attached adjacent the door 74 for resting the door 74 and at least some of the weight of the apparatus on another object (e.g., the edge of a toilet as shown in FIGS. 19 and 20). A modified door mechanism 72' includes a handle 114 attached to the string 80. The handle 114 can be placed at a first catch position adjacent a first catch barrier 116, leaving the door 74 in an open position as shown in FIG. 21. Alternatively, the handle 114 can be placed in a second catch position adjacent a second catch barrier 118, leaving the door 74 in a closed position as shown in FIG. 19.

Figure 22A:
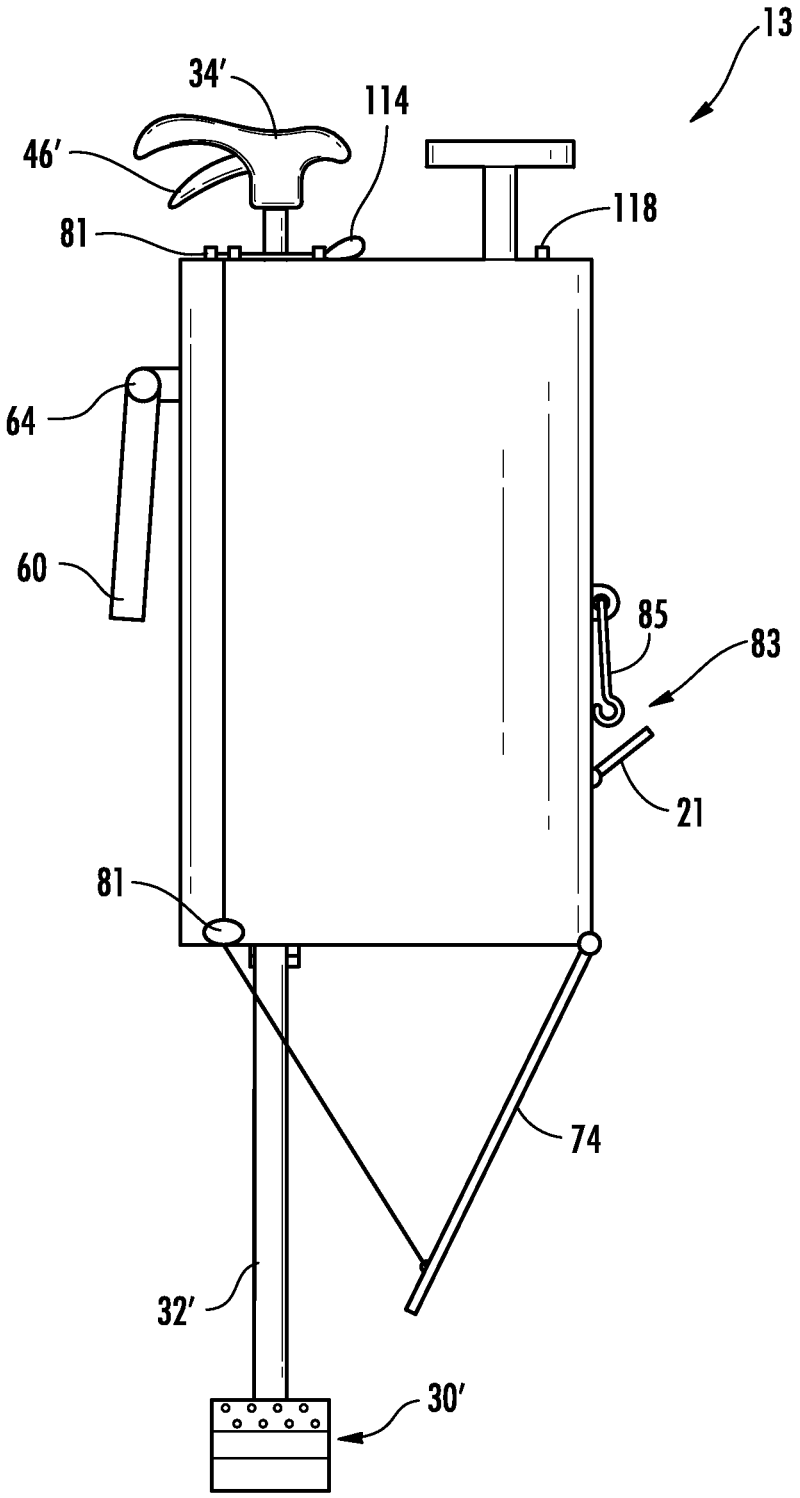
FIG. 22A shows a side view of an embodiment of the invention in a first mechanical configuration.
Figure 22B:
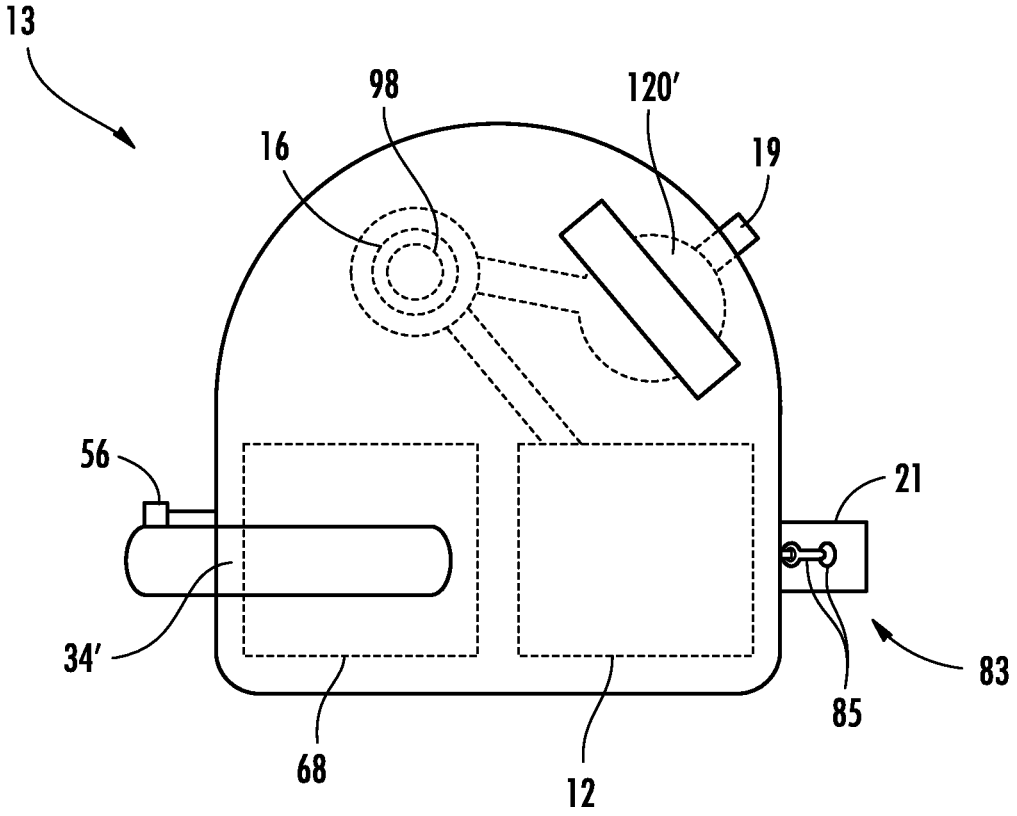
FIG. 22B shows a somewhat schematic top view of the embodiment shown in FIG. 22A including dotted outlines of internal structural features.
Figure 22C:
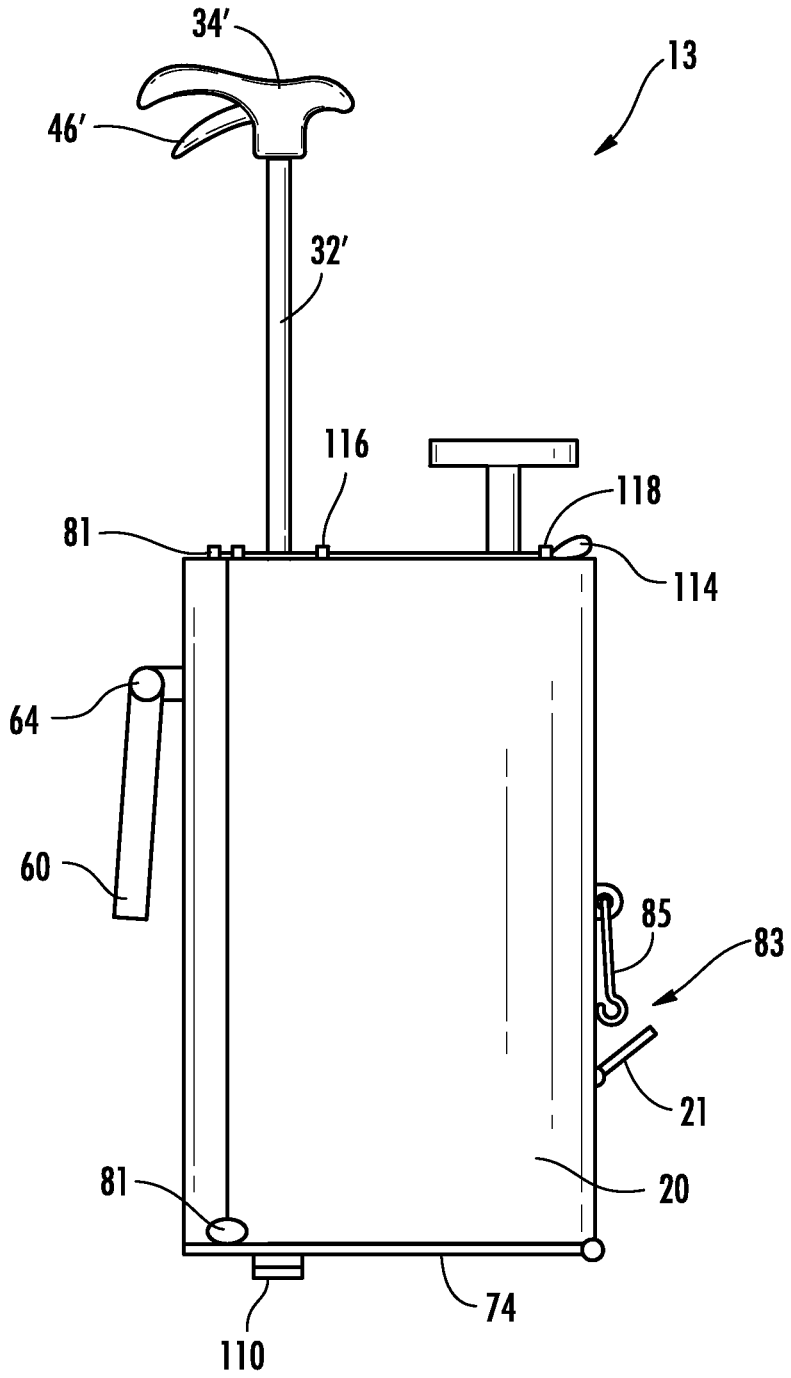
FIG. 22C shows a side view of the embodiment shown in FIGS. 22A and 22B in a second mechanical configuration.

FIGS. 22A-22C show yet another embodiment of a sanitation apparatus 13 including the extraction apparatus 28' including a non-extendable shaft 32'. The sanitation apparatus 13 shown in FIGS. 22A-22C including a pumping mechanism 18 wherein a pumping chamber 120' is located substantially side by side with the storage chamber 12, the extraction chamber 68, and the modified fluid conduit 16' (as opposed to the location of a pumping chamber 120 shown in FIGS. 1, 2, 12, and 16-21). The rearrangement of various parts of the embodiment shown in FIGS. 22A-22C is useful to demonstrate one of many different spatial rearrangements of parts of the general sanitation apparatus described herein.

In addition to the embodiments of an apparatus for extracting and disposing of refuse, a method of removing refuse from a surface and disposing of the refuse is also contemplated in this disclosure. In one embodiment, such a method includes using a single retrieval device with no disposal bags to accomplish the steps of extracting refuse from a surface using an extraction apparatus; transferring at least some of the extracted refuse to a storage chamber that is separate from but attached adjacent to the extraction apparatus; pumping fluid to the storage chamber to form a mixture of pumped fluid and refuse; and releasing at least some of the extracted and stored refuse and at least some of the pumped fluid to a proper disposal source. In a preferred embodiment, the pumping step further includes the step of agitating the mixture of pumped fluid and refuse. Preferably, the agitating step is primarily carried out by the reciprocation of a pump associated with the storage chamber.

A use of the sanitation apparatus 10 and method described herein includes, for example, extracting and properly disposing of animal excrement as shown in FIG. 12. Because of the storage chamber 12, a first clump of animal excrement can be extracted and stored in the storage 12 chamber using the sanitation device without the need of emptying the storage chamber before extracting additional clumps of animal excrement (see, for example, FIGS. 12, 13A, and 13B). In this way, for example, a homeowner could remove multiple clumps of animal excrement in the homeowner's yard and then dispose of the stored clumps of animal excrement in one single step. The accumulated refuse—in this case, animal excrement—could be discharged from the storage chamber 12 into a toilet, thereby properly disposing of such refuse and minimizing the spread of potential disease and harmful organisms.

Another advantage of the apparatus and method described herein is the pumping mechanism (with regard to an apparatus) [or pumping step (with regard to a method)] which allows a user to flush out substantially all of the refuse in the storage chamber 12. The flushing fluid may be provided, for example, from a toilet (examples shown in FIGS. 17 and 19) wherein the gate 20 is preferably opened so as to allow fluid to wash throughout the primary chamber 70. Preferably, the door 74 of the sanitation apparatus 10 is then opened, thereby releasing stored refuse into the toilet as shown in FIGS. 18 and 21, for example.

Embodiments including the wall section 86 with perforations 88 include the additional advantage of mixing stored refuse and fluid pumped in from a fluid source throughout the primary chamber 70 as a whole, thereby loosening stored refuse so that the stored refuse will flush out and release more easily to a disposal location. By using the pump (especially when the fluid channel is substantially blocked, for example, by a removable cap 110 and when the air intake 19 is blocked), any refuse/fluid mixture in the storage chamber may be significantly agitated so as to loosen the stored refuse from the internal surfaces of the sanitation apparatus 10, thereby facilitating the subsequent releasing step of refuse/fluid mixture into a disposal sink such as, for example, a toilet.

Other modified embodiments of similar sanitation apparatuses of different shapes and different construction are contemplated including a sanitation apparatus wherein various moving parts (e.g., the extraction mechanism 14, the gate 20, the door mechanism 72, the actuation system 36, the movable member 38, the transfer mechanism 54, and/or the ram 56, and combinations thereof) are powered by a battery. In one embodiment, the battery is rechargeable.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

Any element in a claim that does not explicitly state "means for" performing a specified function, or "step for" performing a specific function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

What is claimed is:

1. A sanitation apparatus for retrieval and proper disposal of refuse comprising:

a storage chamber for storing refuse;

an extraction mechanism including an extraction apparatus attached adjacent the storage chamber for extracting refuse from a surface;

a fluid conduit attached adjacent a proximal end of the storage chamber;

a pumping mechanism attached proximate the proximal end of the storage chamber, the pumping mechanism in fluid communication with the fluid conduit and the storage chamber, for pumping fluid from a fluid source through the fluid conduit and into the storage chamber; and a gate located adjacent a distal end of the storage chamber, the gate operable to move from a closed gate position for storing refuse within the storage chamber to an open gate position for releasing stored refuse from the storage chamber.

2. The sanitation apparatus of claim 1 further comprising an extraction chamber located adjacent the storage chamber wherein the extraction apparatus is operable to move through at least part of the extraction chamber.

3. The sanitation apparatus of claim 2 further comprising a primary chamber including the extraction chamber and the storage chamber.

4. The sanitation apparatus of claim 3 further comprising a door mechanism including a door actuator and a door located at a distal end of the primary chamber, wherein the door may be moved to an open door position or a closed door position by manipulating the door actuator.

5. The sanitation apparatus of claim 4 further comprising a support catch for use in partially supporting the sanitation apparatus at a location adjacent the fluid source.

6. The sanitation apparatus of claim 4 further comprising a wall section located between the storage chamber and the extraction chamber wherein at least a portion of the wall section includes perforations, the perforations for allowing fluid pumped by the pumping mechanism through the fluid conduit and into the storage chamber to flow between the storage chamber and the extraction chamber.

7. The sanitation apparatus of claim 3 wherein the fluid conduit further comprises an extension member that is extendable beyond the distal end of the primary chamber.

8. The sanitation apparatus of claim 1 further comprising a transfer mechanism for transferring the extracted refuse from the extraction apparatus to the storage chamber.

9. The sanitation apparatus of claim 1 further comprising a check valve for regulating flow of fluid through the fluid conduit into the storage chamber and preventing fluid located in the storage chamber from flowing back into the fluid conduit.

10. The sanitation apparatus of claim 1 wherein the pumping mechanism is selected from the group consisting of a hand powered pump, a battery powered pump, a pump powered by electrical current accessed from a non-battery current source.

11. The sanitation apparatus of claim 1 further comprising a shoulder strap attached adjacent the proximal end of the storage chamber and attached adjacent a distal end of the storage chamber.

12. The sanitation apparatus of claim 1 further comprising a handle attached adjacent the proximal end of the storage tank.

13. The sanitation apparatus of claim 1 wherein the extraction apparatus further comprises an extraction head including a movable member movable between an open extraction head position and a closed extraction head position; a handle; a shaft attached to the extraction head and the handle; and an actuation system including an actuator located proximate the handle, wherein the extraction apparatus can be reciprocated substantially parallel to the storage tank by pushing the handle, and wherein the movable member can be moved to the opened position or the closed position by manipulating the actuator, allowing a user to capture refuse within the extraction head and bring the extracted refuse within the extraction chamber.

14. The sanitation apparatus of claim 13 wherein the extraction head includes a first cross sectional shape, and wherein the transfer mechanism further comprises a ram configured for travel substantially along an imaginary first axis oriented substantially orthogonal to the cross section of the extraction head, wherein extracted refuse can be displaced out of a distal side of the extraction head and into the storage chamber as the ram travels substantially along the imaginary first axis.

15. The sanitation apparatus of claim 14 wherein the ram includes a ram plate having the first cross sectional shape and a ram pole attached to the ram plate for manipulating the ram substantially along the imaginary first axis.

16. The sanitation apparatus of claim 15 wherein the ram pole includes a first portion, and a dynamic fastener attaching the first portion adjacent the ram plate.

17. The sanitation apparatus of claim 13 wherein the shaft further comprises an expandable shaft wherein the length of the shaft can be increased.

* * * * *